US006003607A

United States Patent [19]

Hagen et al.

[11] Patent Number: 6,003,607

[45] Date of Patent: Dec. 21, 1999

[54] WELLBORE EQUIPMENT POSITIONING APPARATUS AND ASSOCIATED METHODS OF COMPLETING WELLS

[75] Inventors: Karluf Hagen, Randaberg, Norway; Colby M. Ross, Carrollton; Ralph H. Echols, Dallas, both of Tex.; Andrew Penno, Olgersdorf, Austria

[73] Assignee: Halliburton Energy Services, Inc., Dallas, Tex.

[21] Appl. No.: 08/712,758

[22] Filed: Sep. 12, 1996

[51] Int. Cl.[6] ..... E21B 23/04; E21B 17/07

[52] U.S. Cl. ..... 166/381; 166/120; 166/318; 175/321

[58] Field of Search ..... 166/120, 125, 166/134, 373, 382, 381; 175/321

[56] References Cited

U.S. PATENT DOCUMENTS

| | | | |
|---|---|---|---|
| 2,761,651 | 9/1956 | Ledgerwood, Jr. | 175/321 X |
| 4,064,953 | 12/1977 | Collins | 175/321 |
| 4,693,316 | 9/1987 | Ringgenberg et al. | 175/321 X |
| 4,778,008 | 10/1988 | Gonzalez et al. . | |
| 4,856,591 | 8/1989 | Donovan et al. | 166/278 |
| 5,029,642 | 7/1991 | Crawford | 166/72 |
| 5,105,890 | 4/1992 | Duguid et al. | 175/321 X |
| 5,311,954 | 5/1994 | Quintana | 175/321 X |
| 5,343,949 | 9/1994 | Ross et al. . | |
| 5,413,180 | 5/1995 | Ross et al. . | |
| 5,566,772 | 10/1996 | Coone et al. | 175/321 |

*Primary Examiner*—Frank Tsay
*Attorney, Agent, or Firm*—Paul I. Herman; Marlin R. Smith

[57] ABSTRACT

Well completion apparatus and associated methods of completing wells provides repositioning of sand control screens and perforating guns without requiring movement of a packer in the wellbore. In a preferred embodiment, a well completion apparatus has a packer, a release apparatus, a telescoping expansion joint, a ball catcher, a sand control screen, and a perforating gun. In another preferred embodiment, a well completion method includes the steps of lowering a packer, release apparatus, telescoping expansion joint, ball catcher, sand control screen, and perforating gun into a well, perforating the wellbore casing, dispensing a sealing ball into the release apparatus, applying pressure to release the release apparatus, and applying pressure to expand the telescoping joint.

28 Claims, 15 Drawing Sheets

WELLBORE EQUIPMENT POSITIONING APPARATUS AND ASSOCIATED METHODS OF COMPLETING WELLS

CROSS-REFERENCE TO RELATED APPLICATION

This application is related to a copending application filed on even date herewith entitled "METHODS OF COMPLETING WELLS UTILIZING WELLBORE EQUIPMENT POSITIONING APPARATUS", attorney docket no. HALB-950134U1, and having Colby M. Ross as the inventor thereof. The copending application is incorporated herein by this reference.

BACKGROUND OF THE INVENTION

The present invention relates generally to apparatus utilized in the completion of subterranean wells and methods of completing such wells, and, in a preferred embodiment thereof, more particularly provides an apparatus which facilitates the placement of sand control screens and perforating guns opposite formations in the wells.

In the course of completing an oil and/or gas well, it is common practice to run a string of protective casing into the wellbore and then to run the production tubing inside the casing. At the wellsite, the casing is perforated across one or more production zones to allow production fluids to enter the casing bore. During production of the formation fluid, formation sand is also swept into the flow path. The formation sand is typically relatively fine sand that tends to erode production equipment in the flow path.

One or more sand screens are typically installed in the flow path between the production tubing and the perforated casing. A packer is customarily set above the sand screen to seal off the annulus in the zone where production fluids flow into the production tubing. In the past, it was usual practice to install the sand screens in the well after the well had been perforated and the guns either removed from the wellbore or dropped to the bottom of the well.

Well completion methods continue to utilize time and resources more efficiently by running the guns, sand screens, and packer into the well on the production tubing in only one trip into the well. From the end of the production tubing down, the completion tool string typically consists of a releasable packer (one capable of being set, released, and reset in the casing, whether by mechanical or hydraulic means), sand control screens, and perforating guns. The completion string is lowered into the well until the guns are opposite the formation to be produced, the packer is set to seal off the annulus above the packer from the formation to be produced, the guns are fired to perforate the casing, the packer is unset, the completion string is again lowered until the sand screens are opposite the perforated casing, the packer is reset, and the formation fluids are then produced from the formation, through the sand screens, into the production tubing, and thence to the surface.

This method has several disadvantages, however. One disadvantage is that a significant amount of rig time is consumed while unsetting, repositioning, and resetting the packer. The rig operator must typically lift the production tubing, manipulate the tubing to unset the packer, lower the tubing into the well a predetermined distance, manipulate the tubing to set the packer, apply tubing weight to the packer, and, finally, perform tests to determine whether the packer has been properly set.

Another disadvantage of the method is that the above-described packer unsetting, repositioning, and resetting must be performed after the casing has been perforated. A necessary consequence of this situation is the possibility that formation fluids may enter the wellbore, and in an extreme situation may even cause loss of control of the well. For this reason, during the packer unsetting, repositioning, and resetting, the well is overbalanced at the formation during these operations—meaning that the pressure in the wellbore is maintained at a level greater than the pressure in the formation. This, in turn, means that wellbore fluids enter the formation through the perforations in the casing, possibly causing damage to the formation.

Furthermore, the method suffers from problems encountered when attempting to reset a packer. In general, modern releasable packers are fairly reliable when lowered into a wellbore and set in casing at a particular location. When, however, a releasable packer is set and then unset and moved to another location, its reliability is greatly diminished. The slips (which grip the interior wall of the casing) may no longer hold fast, and the packer rubbers (which seal against the casing) may not seal adequately a second time.

Additionally, there are other circumstances where, in the drilling, completion, rework, etc. of a well, it is necessary to reposition equipment in the well. Frequently, in these circumstances, it is inconvenient to reposition the equipment by manipulating tubing at the surface, repositioning a packer, or by other methods heretofore known. As an example, in modern practice it is common to run more than one set of perforating guns into a well in one trip. The guns are typically spaced apart with tubing such that each set of guns is positioned opposite a separate formation or pay zone before the guns are fired. If the guns could be repositioned after a first set of guns were fired into a formation, so that a subsequent set of guns would be positioned opposite another formation, the tubing used to space apart the guns could be eliminated and the production string could be shortened.

From the foregoing, it can be seen that it would be quite desirable to provide well completion apparatus which does not require repositioning a releasable packer, but which permits sand control screens to be run into the well with perforating guns in one trip and then positions the sand control screens opposite the formation after the casing has been perforated. It is accordingly an object of the present invention to provide such a well completion apparatus and associated methods of completing wells.

In addition, it is desirable to provide apparatus for positioning equipment in a wellbore. It is accordingly another object of the present invention to provide such positioning apparatus and associated methods of positioning equipment in a wellbore.

SUMMARY OF THE INVENTION

In carrying out the principles of the present invention, in accordance with an embodiment thereof, well completion apparatus is provided which may be utilized for positioning sand screens opposite a formation after perforation of the casing, use of which does not require the user to reposition a packer or manipulate tubing, but which permits the sand screens and perforating guns to be run into the well at one time.

In broad terms, wellbore equipment positioning apparatus is provided which includes inner and outer tubular members, a ball catcher, a fastener, and a seal. The inner and outer tubular members each have upper and lower ends, and inner and outer side surfaces. The inner tubular member is coaxially and telescopingly disposed relative to the outer tubular member.

The ball catcher is sealingly attached to the inner tubular member. The fastener releasably secures the inner tubular member against longitudinal movement relative to the outer tubular member. The seal is disposed between the inner tubular member and the outer tubular member, the seal sealingly contacting the inner tubular member outer side surface and the outer tubular member inner side surface.

Another well equipment positioning apparatus is provided as well. The apparatus includes inner and outer tubular members, a lug, a tubular sleeve, a radially expandable ball seat, and first and second fasteners.

The outer tubular member has upper and lower ends and inner and outer side surfaces, and further has a radially outwardly extending recess formed on its inner side surface. The inner tubular member has upper and lower ends, and inner and outer side surfaces, and the inner tubular member is coaxially and telescopingly disposed relative to the outer tubular member.

The lug has inner and outer side surfaces and is attached to the inner tubular member. The lug is aligned with the recess and is configured for radial movement relative to the recess, the lug outer side surface being received in the recess.

The tubular sleeve is disposed radially inwardly relative to the lug and is longitudinally aligned with the lug. The tubular sleeve has inner and outer side surfaces, with the tubular sleeve outer side surface contacting the lug inner side surface.

The first fastener releasably secures the ball seat against movement relative to the tubular sleeve, and the second fastener releasably secures the tubular sleeve against movement relative to the lug.

Still another wellbore equipment positioning apparatus is provided by the present invention. The apparatus includes inner and outer tubular members, first and second seals, a chamber, a hollow plug, a tubular sleeve, a radially expandable ball seat, and a fastener.

The inner and outer tubular members each have inner and outer side surfaces and upper and lower ends. The inner tubular member is coaxially and telescopingly disposed relative to the outer tubular member.

The first seal sealingly engages the inner tubular member outer side surface and the outer tubular member inner side surface. The chamber is disposed radially between the outer tubular member inner side surface and the inner tubular member outer side surface. The hollow plug has a closed end extending therefrom, the plug being in fluid communication with the chamber.

The tubular sleeve is disposed radially inwardly relative to the plug and is longitudinally aligned with the plug, the tubular sleeve having inner and outer side surfaces. The second seal sealingly engages the outer side surface of the tubular sleeve and the inner side surface of the inner tubular member. The fastener releasably secures the ball seat against movement relative to the tubular sleeve.

Yet another wellbore equipment positioning apparatus is provided. The apparatus includes inner and outer tubular members, first and second seals, a chamber, a hollow plug, a tubular sleeve, and a ball seat.

Each of the inner and outer tubular members has inner and outer side surfaces and upper and lower ends. The inner tubular member is coaxially and telescopingly disposed relative to the outer tubular member.

Each of the first and second seals sealingly engage the inner tubular member outer side surface and the outer tubular member inner side surface. The chamber is disposed radially between the outer tubular member inner side surface and the inner tubular member outer side surface. The hollow plug has a closed end extending therefrom, and the plug is in fluid communication with the chamber.

The tubular sleeve is disposed radially inwardly relative to the plug and is longitudinally aligned with the plug, the tubular sleeve having inner and outer side surfaces. The ball seat is releasably secured against movement relative to the inner tubular member by the plug.

Another wellbore equipment positioning apparatus is provided by the present invention. The apparatus includes inner and outer tubular members, first and second seals, a chamber, a hollow plug, and a tubular sleeve.

Each of the inner and outer tubular members has inner and outer side surfaces and upper and lower ends. The inner tubular member is coaxially and telescopingly disposed relative to the outer tubular member.

The first seal sealingly engages the inner tubular member outer side surface and the outer tubular member inner side surface. The chamber is disposed radially between the outer tubular member inner side surface and the inner tubular member outer side surface. The hollow plug has a closed end extending therefrom. The plug is in fluid communication with the chamber.

The tubular sleeve is disposed radially inwardly relative to the plug and is longitudinally aligned with the plug. The tubular sleeve has inner and outer side surfaces and a shifting tool engagement profile formed on the tubular sleeve inner side surface, the tubular sleeve being releasably secured against movement relative to the plug by the plug. The second seal is longitudinally spaced apart from the first seal, and the second seal sealingly engages the outer side surface of the inner tubular member and the inner side surface of the outer tubular member.

Still another wellbore equipment positioning apparatus is provided. The apparatus includes inner and outer tubular members, a chamber, an opening, first and second seals, and an actuating member.

Each of the inner and outer tubular members has inner and outer side surfaces and upper and lower ends. The outer tubular member inner side surface has a radially enlarged portion disposed between first and second longitudinally spaced apart radially reduced portions formed on the outer tubular member inner side surface. The inner tubular member is coaxially and telescopingly disposed relative to the outer tubular member. The inner tubular member outer side surface has a radially enlarged portion formed thereon, and the inner tubular member outer side surface radially enlarged portion is disposed longitudinally between the outer tubular member inner side surface first and second radially reduced portions.

The chamber is disposed radially between the inner tubular member outer side surface and the outer tubular member inner side surface. The opening is in fluid communication with the chamber.

The first seal sealingly engages the outer tubular member inner side surface first radially reduced portion and the inner tubular member outer side surface. The second seal sealingly engages the inner tubular member outer side surface radially enlarged portion and the outer tubular member inner side surface.

The actuating member has an outer side surface and upper and lower portions. The upper portion is longitudinally aligned with and opposite the opening.

Yet another wellbore equipment positioning apparatus is provided by the present invention. The apparatus includes inner and outer tubular members, first, second, third, and fourth seals, a chamber, an opening, a tubular sleeve, and a fastener.

Each of the inner and outer tubular members has inner and outer side surfaces and upper and lower ends. The outer tubular member inner side surface has a radially enlarged portion and longitudinally spaced apart first and second radially reduced portions formed thereon. The outer tubular member inner side surface radially enlarged portion is disposed between the outer tubular member inner side surface first and second radially reduced portions.

The inner tubular member is coaxially and telescopingly disposed relative to the outer tubular member. The inner tubular member outer side surface has a radially enlarged portion and longitudinally spaced apart first and second radially reduced portions formed thereon. The inner tubular member outer side surface radially enlarged portion is disposed between the inner tubular member outer side surface first and second radially reduced portions.

The first seal sealingly engages the inner tubular member outer side surface radially enlarged portion and the outer tubular member inner side surface radially enlarged portion. The second seal sealingly engages the inner tubular member outer side surface second radially reduced portion and the outer tubular member inner side surface second radially reduced portion.

The chamber is disposed radially between the outer tubular member inner side surface radially enlarged portion and the inner tubular member outer side surface second radially reduced portion. The opening is in fluid communication with the chamber. The tubular sleeve is disposed radially inwardly relative to the opening and is longitudinally aligned opposite the opening. The tubular sleeve has inner and outer side surfaces and a shifting tool engagement profile formed on the tubular sleeve inner side surface.

The third and fourth seals are longitudinally spaced apart. Each of the third and fourth seals sealingly engages the tubular sleeve outer side surface, and the third and fourth seals longitudinally straddle the opening. The fastener releasably secures the tubular member against movement relative to the opening.

Another wellbore equipment positioning apparatus is provided by the present invention. The apparatus includes a generally tubular outer assembly having an outer tubular member and an inner assembly axially slidably received at least partially within the outer assembly. The inner assembly includes a wellbore equipment, and the outer tubular member at least partially outwardly surrounds the wellbore equipment.

A release mechanism releasably secures the inner assembly against axial displacement relative to the outer assembly. The wellbore equipment is releasable for axial displacement relative to the outer assembly, such that the wellbore equipment extends axially outward from the outer assembly.

Methods of completing wells are also provided by the present invention. A method of positioning first and second equipment within a subterranean wellbore comprises the steps of attaching the first and second equipment to a device having a variable axial length; disposing the device and the first and second equipment within the wellbore; disposing the first equipment relative to a formation intersected by the wellbore; and varying the axial length of the device to thereby dispose the second equipment relative to the formation.

In another method, a wellbore equipment positioning apparatus is disposed within a wellbore attached to a perforating gun and a sand control screen. After a formation intersected by the wellbore has been perforated, the apparatus is actuated to extend the apparatus and, thereby, position the sand control screen opposite the perforated formation.

The use of the disclosed apparatus and methods will permit rig time to be used more efficiently. Additionally, the invention adds to the means currently available for positioning equipment in a well.

DETAILED DESCRIPTION

Figure 1A:
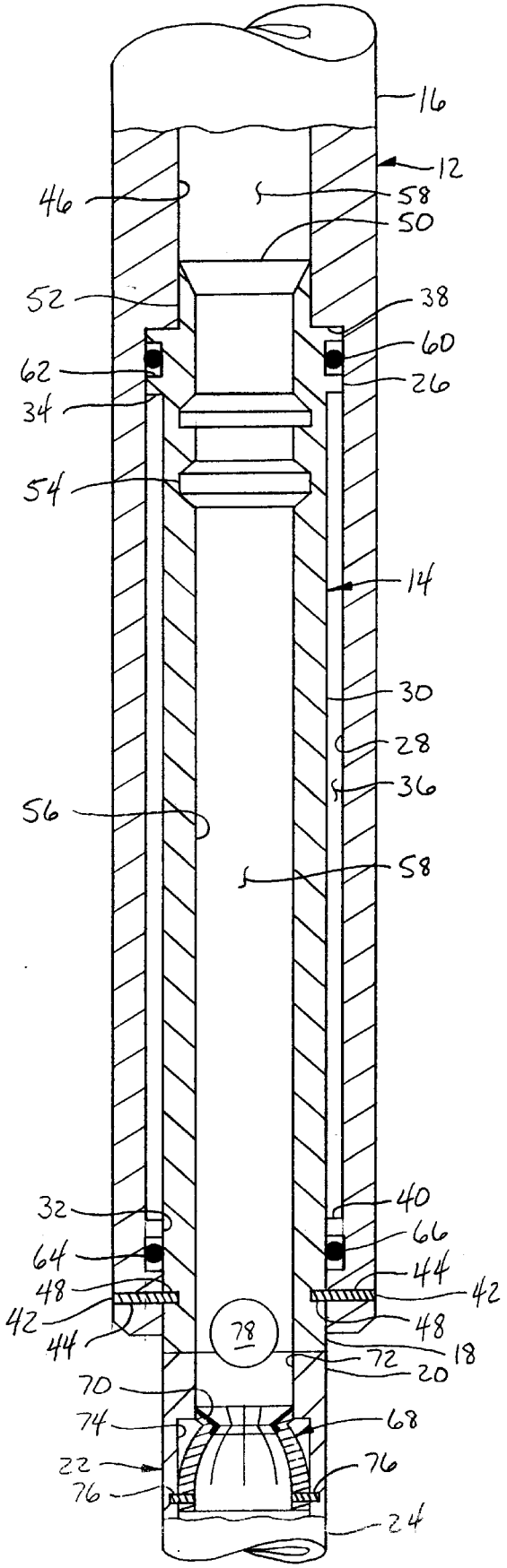
FIG. 1A is a schematicized partially cross-sectional view of a wellbore equipment positioning apparatus embodying principles of the present invention in a compressed configuration thereof.

Throughout the following description of the present invention shown in various embodiments in the accompanying figures, the upward direction shall be used to indicate a direction toward the top of the drawing page and the downward direction shall be used to indicate a direction toward the bottom of the drawing page. It is to be understood, however, that the present invention in each of its embodiments is operative whether oriented vertically or horizontally, or inclined in relation to a horizontal or vertical axis.

Illustrated in FIG. 1A is a wellbore equipment positioning apparatus 10 which embodies principles of the present invention. As will become apparent to those having ordinary skill in the art from consideration of the following detailed description and accompanying drawings, the apparatus 10 may be utilized for positioning various types of equipment in a subterranean wellbore. The equipment may include items such as perforating guns, sand screens, packers, etc. The following description and drawings of the apparatus 10, and others described herein embodying principles of the present invention, are not intended to, and do not, circumscribe the uses thereof contemplated by the applicants.

The apparatus 10 includes coaxial telescoping inner and outer tubular members 14 and 12, respectively. In a preferred manner of using the apparatus 10, an end portion 16 of outer tubular member 12 is sealingly attached to a packer (not shown in FIG. 1A) or other means of securing the end portion 16 against axial displacement in the wellbore. End portion 18 of inner tubular member 14 is sealingly attached to an outer housing 20 of a conventional ball catcher 22, an end portion 24 of which is attached to an item of equipment (not shown in FIG. 1A). In this manner, the apparatus 10, disposed between the packer and the equipment, is capable of displacing the equipment axially within the wellbore relative to the packer.

As representatively illustrated in FIG. 1A, inner and outer tubular members 12 and 14 are coaxial and overlapping in relationship to each other in a telescoping fashion. Radially enlarged outer diameter 26 on inner tubular member 14 is slightly smaller in diameter than polished inner diameter 28 of outer tubular member 12, and polished outer diameter 30 of inner tubular member 14 is slightly smaller than radially reduced inner diameter 32 of outer tubular member 12. This allows radially enlarged portion 34 of inner tubular member 14 to travel longitudinally in an annular space 36 bounded radially by inner diameter 28 and outer diameter 18 and longitudinally by radially extending internal shoulders 38 and 40 of outer tubular member 12. Internal diameter 46 of the outer tubular member 12 is slightly larger than external diameter 52 of end portion 50 of the inner tubular member 14.

Shear pins 42, each installed in a radially extending hole 44 formed through the outer tubular member 12 and extending into radially extending hole 48 formed radially into the inner tubular member 14, maintain the overlapping, axially compressed, relationship of the inner and outer tubular members, thereby securing against axial movement of one relative to the other. The number of shear pins 42 is selected so that a predetermined force is necessary to shear the pins and permit inner tubular member 14 to move axially relative to outer tubular member 12. A conventional latch profile 54 is formed in an interior bore 56 of inner tubular member 14 so that a conventional latch member, such as a slickline shifting tool, may latch onto the inner tubular member if necessary, for purposes described further hereinbelow.

Interior bore 56 of inner tubular member 14 and internal diameter 46 of outer tubular member 12 form a continuous internal flow passage 58 from end portion 16 to end portion 24 of the apparatus 10. To isolate the interior flow passage 58 from any exterior fluids and pressures, seal 60 is disposed in a circumferential groove 62 on the radially enlarged diameter 26. The seal 60 sealingly contacts the polished inner diameter 28 of outer tubular member 12, and will continue to provide sealing contact therewith if inner tubular member 14 is displaced axially relative to outer tubular member 12. A debris seal 64, disposed in a circumferential groove 66 formed on radially reduced inner diameter 32, is operative to prevent debris from entering the annular space 36, but allows fluid and pressure communication between the annular space and the wellbore external to the apparatus 10.

Ball catcher 22, as noted above, is of conventional construction and includes a fingered inner sleeve 68. An upper portion of the fingered inner sleeve 68 is radially compressed into a radially reduced inner diameter 72 of outer housing 20 and has a ball seat 70 disposed thereon. Ball seat 70 is specially designed to sealingly engage a ball 78. In a radially enlarged inner diameter 74, the fingered inner sleeve 68 is secured against axial movement relative to outer housing 20 by shear pins 76 extending radially through the fingered inner sleeve and partially into the outer housing. In the configuration representatively illustrated in FIG. 1A, the radially compressed fingered inner sleeve ball seat 70 has an inner diameter smaller than the diameter of the ball 78.

When the ball 78 engages the ball seat 70, forming a fluid and pressure seal therewith, pressure may be applied to the interior flow passage 58 above the ball to create a pressure differential across the ball, and a resulting downward biasing force, to shear the shear pins 76 and permit the fingered inner sleeve 68 to move axially downward relative to the outer housing 20. If the fingered inner sleeve 68 moves a sufficient distance axially downward as viewed in FIG. 1A, the axially compressed ball seat 70 will enter the radially enlarged inner diameter 74 of the outer housing 20 and expand so that its inner diameter will be larger than that of the ball 78. When this occurs, the ball 78 is permitted to pass through the ball catcher 22 and is therefore no longer sealingly engaged with the ball seat 70.

It will be readily apparent to one skilled in the art that if the pressure applied to the interior flow passage 58 is greater than the pressure existing external to the apparatus 10, a resulting downwardly biased axial force will also be applied to the inner tubular member 14. If the resulting force applied to the inner tubular member 14 exceeds the predetermined force selected to shear the shear pins 42 securing the inner tubular member 14 against axial movement relative to the outer tubular member 12, the shear pins 42 will shear and the resulting force will cause the inner tubular member 14 to move axially downward as viewed in FIG. 1A relative to the outer tubular member 12 until the enlarged portion 34 of the inner tubular member strikes the internal shoulder 40 of the outer tubular member. This is a preferred method of extending the inner tubular member 14 from within the outer tubular member 12 (decreasing the length of each which overlaps the other), so that the distance from the end portion 16 of the outer tubular member 12 to the end portion 24 of the ball catcher 22 is thereby enlarged.

In order for the apparatus 10 to be properly configured for operation according to the above described preferred method, the predetermined force necessary to shear the shear pins 42 securing the inner tubular member 14 against axial movement relative to the outer tubular member 12 must correspond to a pressure applied to the interior flow passage 58 above the ball 78 which is less than the pressure required to shear the shear pins 76 securing the fingered inner sleeve 68 against axial movement relative to the outer housing 20.

If a circumstance should occur wherein it is not possible to extend the apparatus 10 by applying pressure to the interior flow passage 58 to shear the shear pins 42, the shear pins 42 may alternatively be sheared by latching a conventional shifting tool into the latch profile 54 and applying the predetermined force downward on the inner tubular member 14. Such a circumstance may occur, for example, when debris prevents the sealing engagement of the ball 78 with the ball seat 70.

Figure 1B:
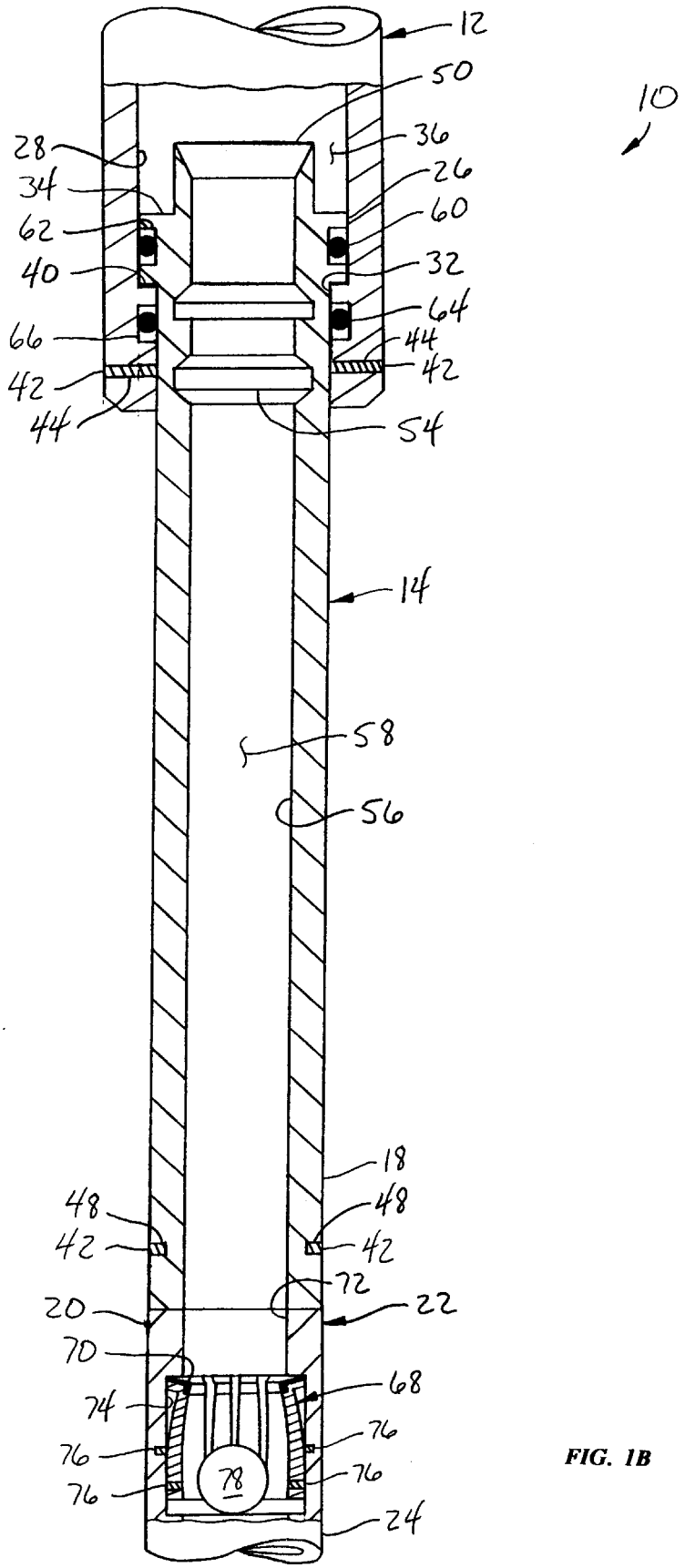
FIG. 1B is a schematicized partially cross-sectional view of the apparatus illustrated in FIG. 1A in an extended configuration thereof.

Turning now to FIG. 1B, the apparatus 10 of FIG. 1A is shown in its fully extended configuration. Shear pins 42 have been sheared, allowing the inner tubular member 14 to move axially downward as viewed in FIG. 1B until the radially enlarged portion 34 contacts the inner shoulder 40 of the outer tubular member 12. Movement of the inner tubular member 14 relative to the outer tubular member 12 after the shear pins 42 are sheared may be caused by the force resulting from the pressure applied to the interior flow passage 58 or, if the apparatus 10 is oriented at least partially vertically, by the weight of the inner tubular member 14, ball catcher 22, and the equipment attached thereto, or by any combination thereof.

As viewed in FIG. 1B, the shear pins 76 have also been sheared and the fingered inner sleeve 68 has been shifted axially downward relative to the outer housing 20 of the ball catcher 22, permitting the ball seat 70 to expand into the enlarged diameter 74. The ball 78 is thus permitted to pass through the ball seat 70.

As described hereinabove, the pressure applied to the inner flow passage 58 to shear the shear pins 76 in the ball catcher 22 is greater than the pressure required to shear the shear pins 42 which secure the inner tubular member 14 against axial movement relative to the outer tubular member 12. Thus, as pressure is built up in the inner flow passage 58, the shear pins 42 shear first, the inner tubular member 14 then moves axially downward as viewed in FIG. 1B, and then the pressure build-up continues in the inner flow passage until the shear pins 76 in the ball catcher 22 shear, releasing the ball 78.

Figure 2A:
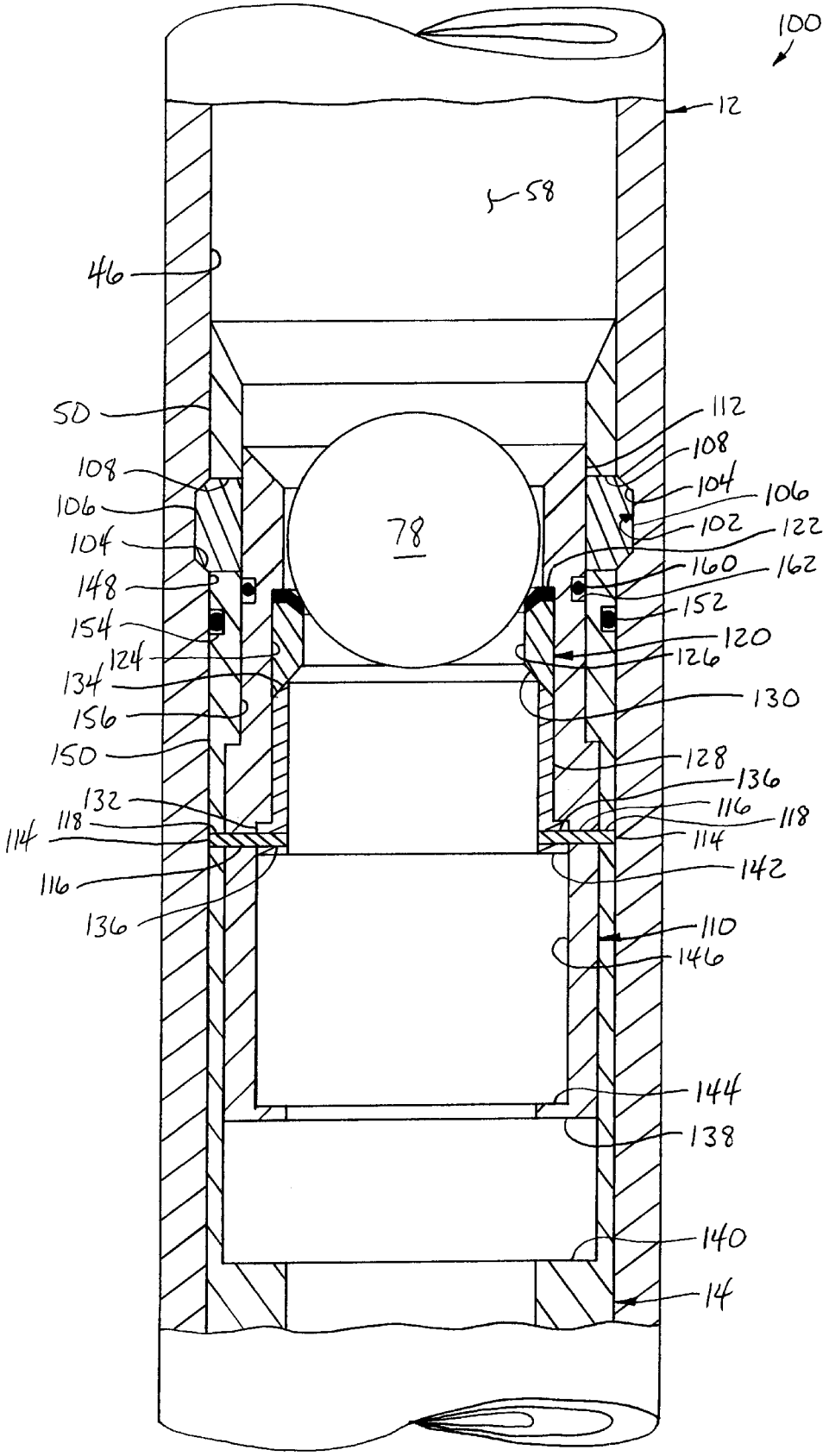
FIG. 2A is a schematicized partially cross-sectional view of a release mechanism embodying principles of the present invention in a secured configuration thereof.

Turning now to FIG. 2A, an alternative device 100 is shown for releasably securing the inner tubular member 14 against axial movement relative to the outer tubular member 12 in the apparatus 10. Device 100 eliminates the need for the ball catcher 22 disposed between the end portion 18 of the inner tubular member 14 and the equipment described hereinabove as being attached to the end portion 24 of the ball catcher 22. Additionally, device 100 eliminates the possibility that the shear pins 42 may be sheared or otherwise damaged while the apparatus 10 is run in the wellbore.

Device 100 includes a circumferential groove 102 formed on the internal diameter 46 of the outer tubular member 12. Opposite radially extending shoulders 104 of the groove 102 are longitudinally sloped. A plurality of complimentarily shaped lugs or collets 106 extend radially outwardly into the groove 102. The lugs 106 also extend radially inwardly through complimentarily shaped apertures 108 formed through the end portion 50 of inner tubular member 14.

Maintaining the lugs 106 in cooperative engagement with the groove 102 is a sleeve 110, an outer diameter 112 of which is in contact with the lugs and which prevents the lugs from moving radially inwardly. Sleeve 110 is secured against axial movement relative to the inner tubular member 14 by radially extending shear pins 114 which extend through holes 116 in the sleeve 110 and holes 118 in the inner tubular member 14. Thus, as long as shear pins 114 remain intact, sleeve 110 is secured against axial movement relative to inner tubular member 14 and lugs 106 are maintained in cooperative engagement with groove 102, thereby securing the inner tubular member 14 against axial movement relative to the outer tubular member 12.

A conventional compressible ball seat 120, having on opposite ends an upper ball sealing surface 122 and a lower radially extending and longitudinally sloping surface 130, is radially compressed and coaxially disposed in an inner diameter 124 of the sleeve 110. While disposed in the inner diameter 124, the ball seat 120 remains radially compressed, such that inner diameter 126 of the ball seat 120 and the ball sealing surface 122 is less than the diameter of the ball 78, preventing the ball from passing axially therethrough and permitting the ball to sealingly engage the ball sealing surface.

The compressible ball seat 120 is maintained in the inner diameter 124 and secured against axial displacement relative to the sleeve 110 by coaxially disposed inner mandrel 128, having on opposite ends a radially enlarged outer diameter 132 and a radially extending and longitudinally sloping surface 134. The sloping surface 134 is configured to complimentarily engage the radially sloping surface 130 of the compressible ball seat 120. The inner mandrel 128 is secured against axial movement relative to the sleeve 110 by radially extending shear pins 114 which extend through holes 136 formed in inner mandrel 128.

Shear pins 114 thus extend radially through holes in the inner mandrel 128, sleeve 110, and inner tubular member 14, securing each against axial movement relative to the others. If shear pins 114 are sheared between the inner tubular member 14 and the sleeve 110, the sleeve is permitted to move axially downward as viewed in FIG. 2B relative to the inner tubular member until lower shoulder 138 of sleeve 110 contacts shoulder 140 of inner tubular member 14. The distance from shoulder 138 to shoulder 140 is sufficiently great that if sleeve 110 moves axially downward as viewed in FIG. 2B sufficiently far for shoulder 138 to contact shoulder 140, lugs 106 will no longer be maintained in radially outward cooperative engagement with groove 102 by the sleeve 110. Lugs 106 will then be permitted to move radially inward, releasing the inner tubular member 14 for axial displacement relative to outer tubular member 12.

Figure 2B:
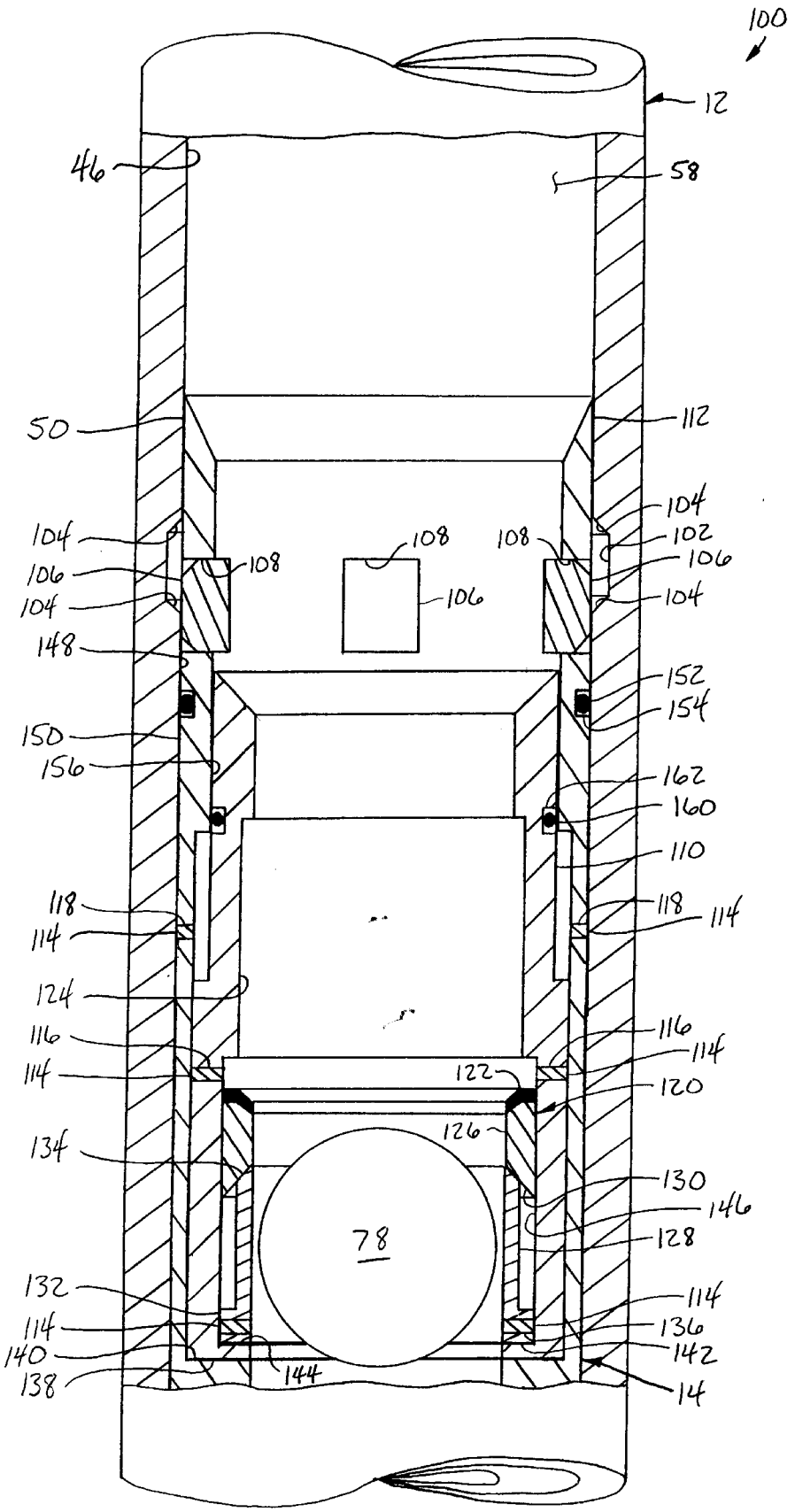
FIG. 2B is a schematicized partially cross-sectional view of the release mechanism illustrated in FIG. 2A in a released configuration thereof.

If shear pins 114 are sheared between the inner mandrel 128 and the sleeve 110, the inner mandrel is permitted to move axially downward as viewed in FIG. 2B until shoulder 142 on the inner mandrel contacts shoulder 144 on the sleeve 110. If the inner mandrel 128 moves axially downward sufficiently far for shoulder 142 to contact shoulder 144, the inner mandrel 128 will no longer maintain the compressible ball seat 120 in the inner diameter 124 of the sleeve 110, and the compressible ball seat will be permitted to move axially downward and expand into radially enlarged inner diameter 146 of the sleeve. If the compressible ball seat 120 expands into the enlarged inner diameter 146, its inner diameter 126 will enlarge to a diameter greater than the diameter of the ball 78, permitting the ball to pass axially through the compressible ball seat 120. Note that sloping surface 134, in complimentary engagement with sloping surface 130 of the compressible ball seat 120 aids in the expansion of the compressible ball seat when it enters the enlarged inner diameter 146 of the sleeve 110.

Inner diameter 148 of outer tubular member 12 has a polished surface and is slightly larger than outside diameter 150 of inner tubular member 14. A seal 152 disposed in a circumferential groove 154 formed on outside diameter 150 provides a fluid and pressure seal between the inner and outer tubular members 14 and 12. Inner diameter 156 of inner tubular member 14 has a polished surface and is slightly larger than outside diameter 112 of sleeve 110. A seal 160 disposed in a circumferential groove 162 formed on outside diameter 112 provides a fluid and pressure seal between the inner tubular member 14 and the sleeve 110. Note that when the ball 78 is sealingly engaged on ball sealing surface 122, and pressure is applied to the inner flow passage 58 above the ball 78 as viewed in FIG. 2A, a larger piston area is formed by seal 160 than is formed by the ball sealing surface 122. Thus, as will be readily appreciated by one skilled in the art, the resulting downwardly biasing force borne by the shear pins 114 between the inner tubular member 14 and the sleeve 110 is greater than the resulting force borne by the shear pins 114 between the inner mandrel 128 and the sleeve 110. Or, put another way, a greater pressure must be applied to the inner flow passage 58 above the ball 78 to shear the shear pins 114 between the sleeve 110 and the inner mandrel 128 than must be applied to shear the shear pins 114 between the sleeve 110 and the inner tubular member 14. of course, additional shear pins 114, and/or larger shear pins, may be utilized to increase the pressure required to shear the shear pins. In addition, it is not necessary for the same shear pins 114 to secure the inner mandrel 128, sleeve 110, and inner tubular member 14 against relative axial movement, since separate shear pins may also be utilized.

Turning now to FIG. 2B, the device 100 is shown after the shear pins 114 have been sheared, both between the sleeve 110 and the inner tubular member 14 and between the inner mandrel 128 and the sleeve 110. For illustrative clarity, the inner tubular member 14 is shown as being only slightly moved axially downward relative to the outer tubular member 12, but it is to be understood that, as with the apparatus 10 representatively illustrated in FIG. 1B, the inner tubular member 14, once released, may be permitted to move a comparatively much larger distance axially relative to the outer tubular member 12.

When ball 78 is installed in inner flow passage 58, sealingly engaging ball sealing surface 122, and sufficient pressure is applied to the inner flow passage above the ball, shear pins 114 shear initially between the inner tubular member 14 and the sleeve 110. The force resulting from the pressure differential across the ball 78 moves the sleeve 110 downward, uncovering the lugs 106, and permitting the lugs to move radially inward. The inner tubular member 14 is thus permitted to move axially downward relative to the outer tubular member 12. The pressure differential across the ball 78 may then be used, if necessary, to force the inner tubular member 14 to extend telescopically from within the outer tubular member 12.

When the inner tubular member 14 is completely extended, application of additional pressure to the inner flow passage 58 above the ball 78 may be used to produce a sufficient differential pressure across the ball to shear the shear pins 114 between the sleeve 110 and the inner mandrel 128. The differential pressure will then force the inner mandrel 128 and compressible ball seat 120 axially downward until the compressible ball seat enters the radially enlarged inner diameter 146 of the sleeve 110 and expands. Sloping surface 134 on the inner mandrel 128, in contact with the sloping surface 130 on the compressible ball seat 120, aids in expanding the compressible ball seat 120. When the compressible ball seat 120 has expanded into the radially enlarged inner diameter 146, the inside diameter 126 of the ball sealing surface 122 and compressible ball seat 120 is larger than the diameter of the ball 78, and the ball is permitted to pass axially through the compressible ball seat 120.

Figure 3A:
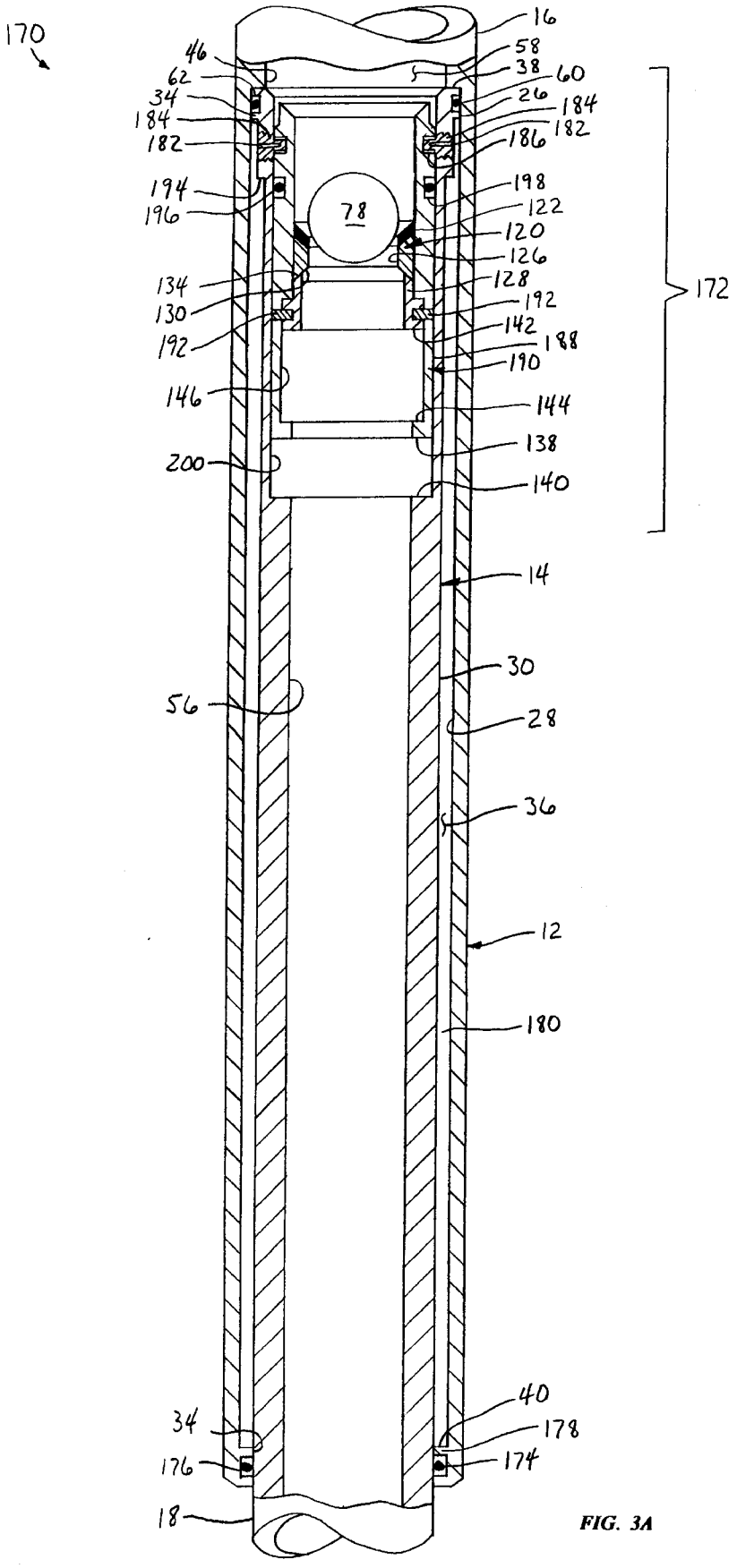
FIG. 3A is a schematicized partially cross-sectional view of another wellbore equipment positioning apparatus embodying principles of the present invention in a compressed position thereof.

Turning now to FIG. 3A, another apparatus 170 for positioning equipment within a wellbore embodying the principles of the present invention may be seen in a compressed configuration thereof. Apparatus 170 includes a release mechanism 172. For convenience and clarity of the following description of the apparatus 170 and release mechanism 172, some elements shown in FIG. 3A have the same numbers as those elements having substantially similar functions which were previously described in relation to FIGS. 1A–2B.

Apparatus 170 includes outer and inner coaxial telescoping tubular members 12 and 14, respectively. Upper end 16 of outer tubular member 12 is secured against axial movement relative to the wellbore by, for example, attachment to a packer set in the wellbore, suspension from slips or an elevator on a rig, etc. Equipment, such as screens, perforating guns, etc., is attached to the lower end 18 of the inner tubular member 14.

An annular area 36 between a polished inside diameter 28 of the outer tubular member 12 and a polished outer diameter 30 of the inner tubular member 14 is substantially filled with a substantially incompressible liquid 180, for example, oil or silicone fluid. The annular area 36 is sealed at opposite ends by seal 60 in groove 62 on radially enlarged portion 34 of the inner tubular member 14 and by seal 174 in groove 176 on radially reduced diameter portion 178 of the outer tubular member 12. In the configuration illustrated in FIG. 3A, inner tubular member 14 is prevented from moving axially upward relative to outer tubular member 12 by contact between the enlarged portion 34 of the inner tubular member 14 and an internal shoulder 38 formed in the outer tubular member 12. Inner tubular member 14 is prevented from moving appreciably axially downward relative to outer tubular member 12 by the substantially incompressible liquid 180 in the annular area 36.

To permit movement of the inner tubular member 14 downward relative to the outer tubular member 12, in order to alter the position of the equipment in the wellbore, the liquid 180 is permitted to escape from the annular area 36 through apertures 182 in conventional break plugs 184. The break plugs 184 are threadedly and sealingly installed in the inner tubular member 14 so that they extend radially inward from the annular area 36 and through the inner tubular member 14. The apertures 182 extend radially inward from an end of each break plug 184 exposed to the annular area 36, and into, but not through, an end of the break plug 184 which extends radially inward into a circumferential groove 186 formed on an outer diameter 188 of a sleeve 190.

As will be readily appreciated by a person of ordinary skill in the art, if sleeve 190 moves axially downward relative to the inner tubular member 14, thereby shearing the portions of the break plugs 184 which extend into groove 186, apertures 182 will form flow paths for fluid communication between the annular area 36 and inner flow passage 58. If the pressure existing in the inner flow passage 58 is greater than the pressure existing external to the apparatus 170, or if the weight of the equipment pulling downward on the inner tubular member 14 is sufficiently great, the liquid 180 will be forced through the apertures 182 and into the inner flow passage 58 as the annular area 36 decreases in volume. In this manner, the inner tubular member 14 is permitted to move axially downward relative to the outer tubular member 12.

In the release mechanism 172, the sleeve 190 is made to move downward relative to the inner tubular member 14 to shear the break plugs 184 by substantially the same method as that used to move the sleeve 110 downward relative to the inner tubular member 14 to release the lugs 106 in the release mechanism 100 illustrated in FIGS. 2A and 2B described hereinabove. A ball 78 is installed in sealing engagement with a ball sealing surface 122 on a compressible ball seat 120. A seal 196 disposed in a circumferential groove 198 formed on outside diameter 188 of the sleeve 190 sealingly engages a polished enlarged inside diameter 200 of the inner tubular member 14. Pressure is applied to the inner flow passage above the ball 78 so that a pressure differential is created across the ball. The force resulting from the differential pressure across the ball 78 pushes axially downward on the ball seat 120, which in turn pushes axially downward against an inner mandrel 128. The inner mandrel 128 is restrained against axial movement relative to the sleeve 190 by radially extending shear pins 192. When the resulting force is sufficiently large, the break plugs 184 shear, permitting the sleeve 190 to move axially downward relative to the inner tubular member 14, permitting the liquid 180 in the annular area 36 to flow through apertures 182 and into the inner flow passage 58, thereby permitting the inner tubular member 14 to move axially downward relative to the outer tubular member 12.

When the inner tubular member 14 has been extended fully from within the outer tubular member 12, shoulder 194 on the inner tubular member 14 contacts shoulder 40 on radially reduced diameter portion 178 of the outer tubular member 12, preventing further axially downward movement of the inner tubular member relative to the outer tubular member. Application of additional pressure to the inner flow passage 58 above the ball 78 is then utilized to shear pins 192 securing inner mandrel 128 against axial movement relative to the sleeve 190. The force resulting from this application of additional pressure then moves the ball 78, compressible ball seat 120, and inner mandrel 128 axially downward relative to the sleeve 190 until shoulder 142 on the inner mandrel contacts shoulder 144 on the sleeve 190, permitting the compressible ball seat 120 to enter a radially enlarged diameter 146 on the sleeve. When the compressible ball seat 120 enters the diameter 146 it expands radially, aided by a radially extending and longitudinally sloped surface 134 on the inner mandrel 128 in contact with a complimentarily sloped surface 130 on the compressible ball seat 120, such that its inside diameter 126 becomes larger than the diameter of the ball 78. The ball 78 may then pass freely axially through the compressible ball seat 120. Note that for the proper sequential shearing of the break plugs 184 and shear pins 192, the pressures applied to the inner flow passage 58 above the ball 78 to create a pressure differential across the ball must be preselected so that less pressure is required to shear the break plugs 184 than to shear the shear pins 192.

Figure 3B:
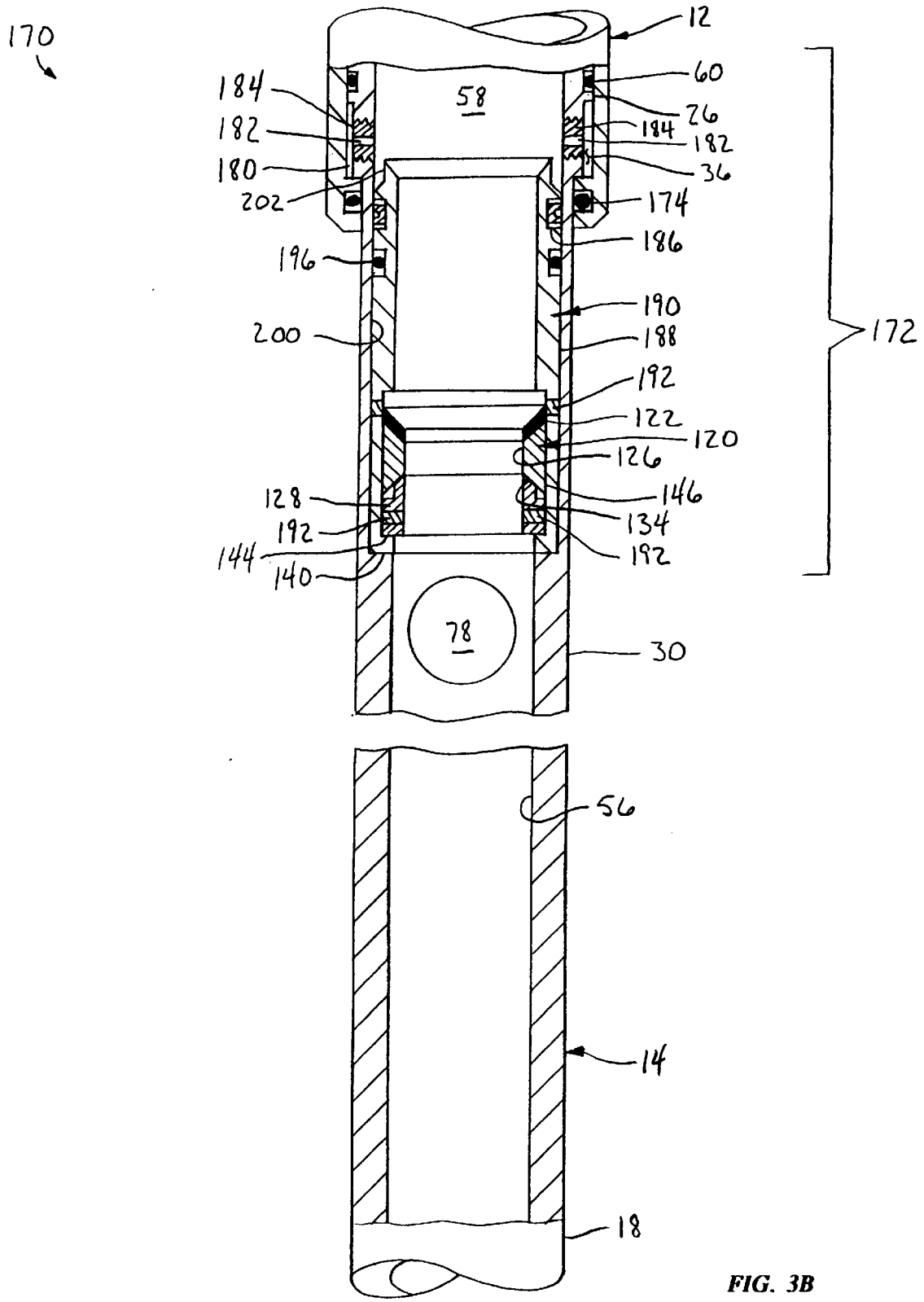
FIG. 3B is a schematicized partially cross-sectional view of the apparatus illustrated in FIG. 3A in an extended configuration thereof.

Illustrated in FIG. 3B is the apparatus 170 shown in FIG. 3A in an extended configuration thereof. The break plugs 184 have been sheared and substantially all of the fluid 180 has escaped from the annular area 36 into the inner flow passage 58. A radially reduced outer diameter 202 on the sleeve 190 provides a flow path about the sleeve.

The shear pins 192 have also been sheared, permitting the inner mandrel 128 and compressible ball seat 120 to move axially downward relative to the sleeve 190 and permitting the compressible ball seat 120 to expand radially into the enlarged inside diameter 146. Ball 78 may now pass axially through the radially expanded inside diameter 126 of compressible ball seat 120. The inner tubular member 14 has thus been axially extended from within the outer mandrel 12 to alter the position in the wellbore of the equipment attached to the lower end 18 of the inner tubular member 14.

Figure 4A:
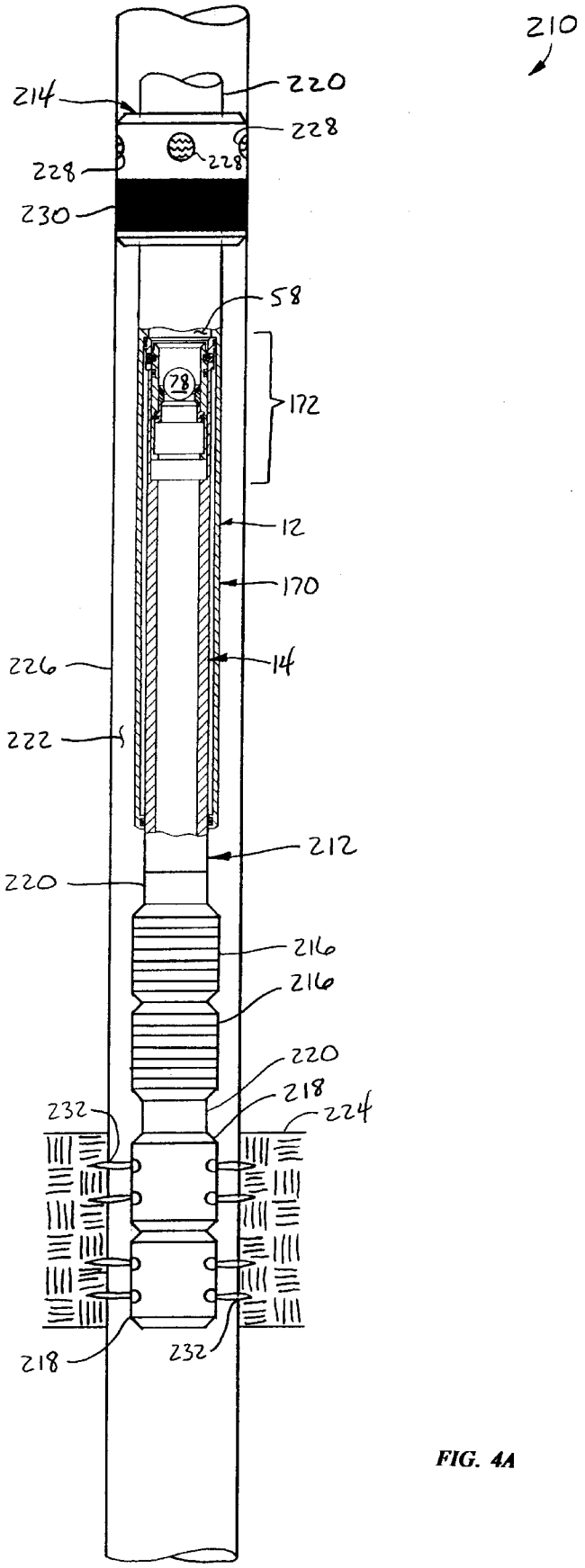
FIG. 4A is a schematicized partially cross-sectional view of a method of completing a subterranean well embodying principles of the present invention utilizing the apparatus illustrated in FIG. 3A, here shown in a compressed configuration thereof, with a zone to be produced being perforated.

Illustrated in FIG. 4A is a preferred method 210 of using the apparatus 170 shown in FIGS. 3A and 3B to complete a well. The apparatus 170, utilizing release mechanism 172 and configured in its axially compressed configuration as shown in FIG. 3A, is attached in a tool string 212 between a conventional packer 214 and a pair of conventional sand screens 216.

The tool string 212 includes, in order from the bottom upward, a pair of conventional perforating guns 218, a section of tubing 220, the sand screens 216, another section of tubing 220, the apparatus 170, the packer 214, and further tubing 220 extending to the surface. It is to be understood that the tool string 212 may include other and different items of equipment for use in a wellbore 222 which are not shown in FIG. 4A without deviating from the principles of the present invention. It is also to be understood that, although the tool string 212, including the apparatus 170, is illustrated in FIG. 4A as being oriented vertically, and the following description of the preferred method 210 refers to this vertical orientation through the use of terms such as "upward", "downward", "above", "below", etc., the tool string 212 may also be oriented horizontally, inclined, or inverted, and these directional terms are used as a matter of convenience to refer to the orientation of the tool string as illustrated in FIG. 4A.

The tool string 212 is lowered longitudinally into the wellbore 222 from the surface until the perforating guns 218 are positioned longitudinally opposite a potentially productive formation 224. The packer 214 is then set in casing 226 lining the wellbore 222. As the packer 214 is set, slips 228 bite into the casing 226 to prevent axial movement of the tool string 212 relative to the wellbore 222, and rubbers 230 expand radially outward to sealingly engage the casing 226.

The perforating guns 218 are fired radially outward, forming perforations 232 extending radially outward through the casing 226 and into the formation 224. The perforations 232 are formed so that hydrocarbons or other useful fluids in the formation 224 may enter the wellbore 222 for transport to the surface. Note that many conventional methods have been developed for firing the perforating guns 218, none of which are described herein as they are not within the scope of the present invention.

The apparatus 170 is then extended axially as set forth in the detailed description above in relation to FIGS. 3A and 3B. The ball 78 is installed into the release mechanism 172 and pressure is applied to the inner flow passage 58 above the ball to shear the break plugs 184, thus permitting the inner tubular member 14 to move axially downward relative to the outer tubular member 12. Additional pressure is then applied to the inner flow passage 58 above the ball 78 to shear the shear pins 192, thus permitting the ball 78 to pass axially through the compressible ball seat 120 (see FIGS. 3A and 3B).

Figure 4B:
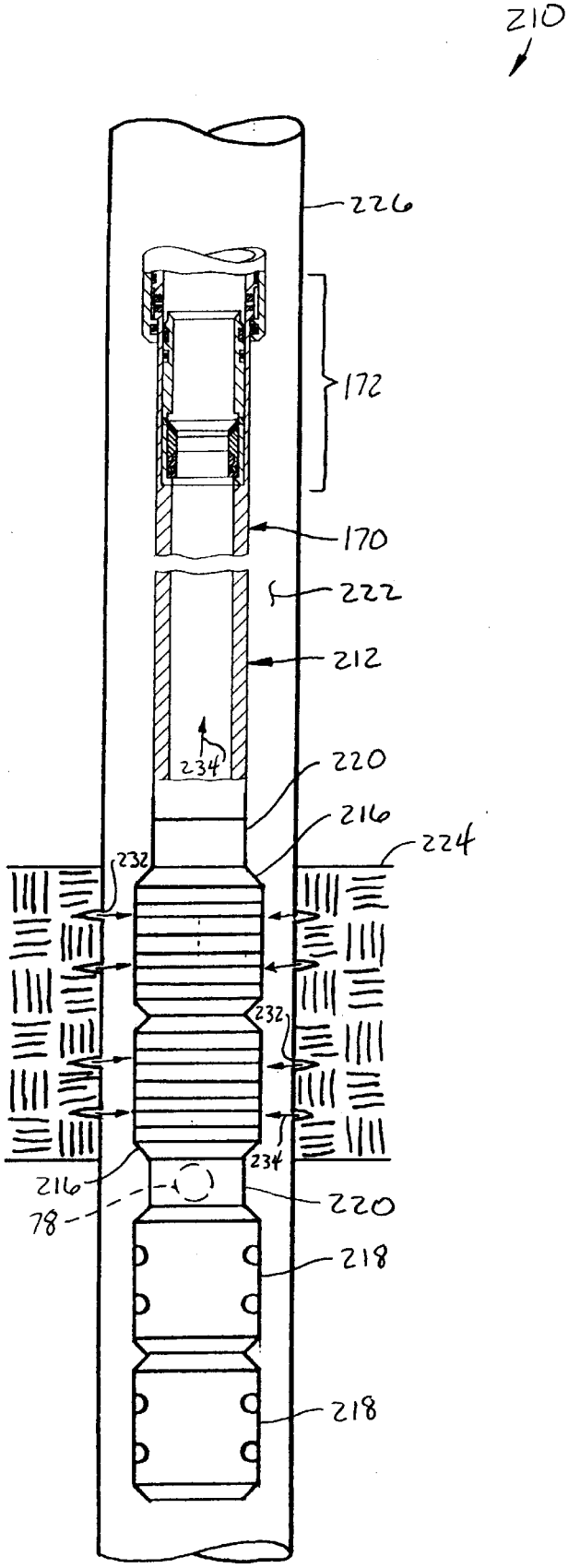
FIG. 4B is a schematicized partially cross-sectional view of a method of completing a subterranean well embodying principles of the present invention utilizing the apparatus illustrated in FIG. 3A, here shown in an extended configuration thereof, with a pair of screens positioned opposite the perforated and producing zone.

FIG. 4B illustrates the method 210 of using the apparatus 170 after the inner tubular member 14 has been axially extended from within the outer tubular member 12. The screens 216 are now positioned longitudinally opposite the formation 224 so that flow 234 from the formation may pass directly through the perforations 232, into the wellbore 222, and thence directly into the screens 216. The screens 216 filter particulate matter from the flow 234 before it enters the tool string 212, so that the particulate matter does not clog or damage any equipment.

Note that the ball 78 has come to rest in the section of tubing 220 between the screens 216 and the perforating guns 218. In this position the ball 78 is not in the way of the flow 234 as it enters the screens 216 and travels toward the surface in the inner flow passage 58.

Figure 5A:
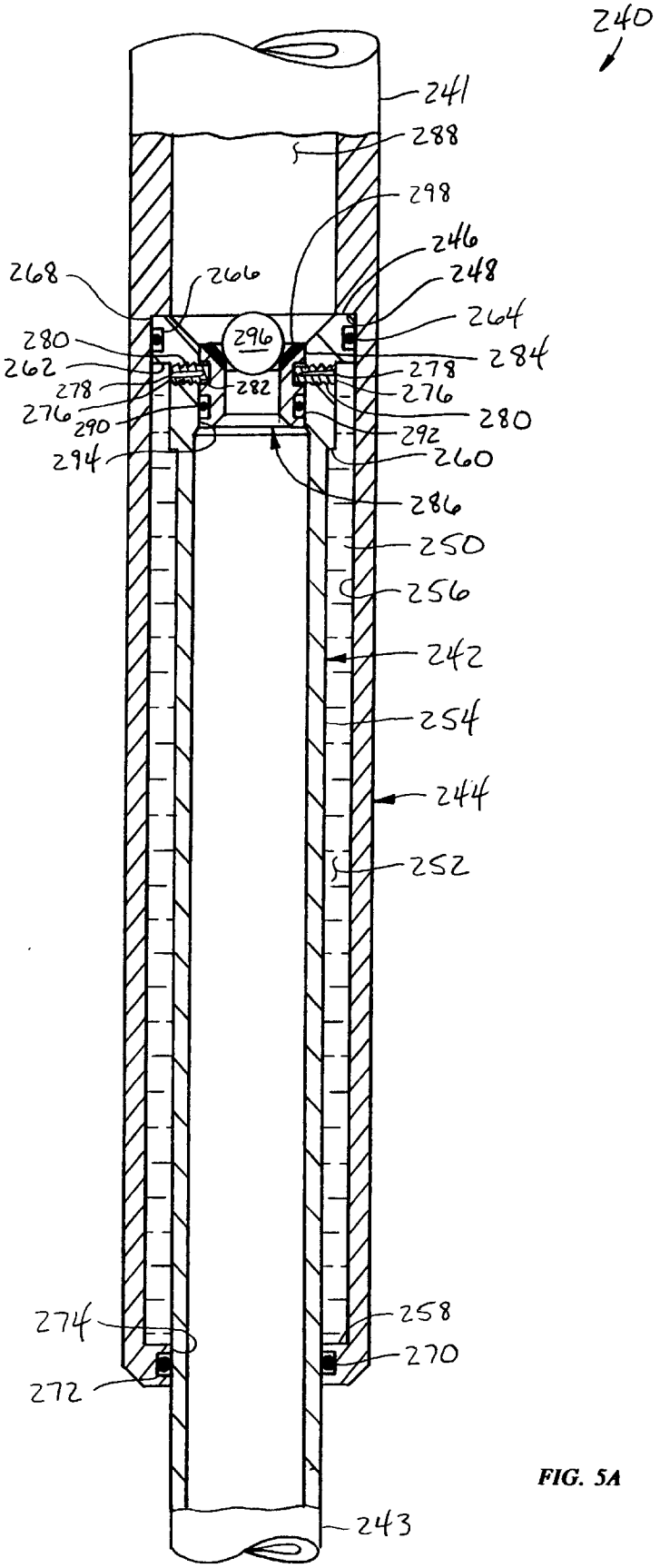
FIG. 5A is a schematicized partially cross-sectional view of yet another wellbore equipment positioning apparatus embodying principles of the present invention in a compressed configuration thereof.

FIG. 5A shows an apparatus 240 for positioning equipment in a wellbore which is another embodiment of the present invention. The apparatus 240 is illustrated in a compressed configuration thereof. Upper end portion 241 is preferably attached to a packer (not shown) or other device for preventing its axial movement within the wellbore. Lower end portion 243 is preferably attached to a single item or multiple items of equipment, for example, tubing, sand screen, or perforating gun. Telescoping coaxial inner and outer tubular members, 242 and 244 respectively, are shown substantially overlapping each other with shoulder 246 on the inner tubular member 242 contacting shoulder 248 on the outer tubular member 244, thereby preventing further compression of the apparatus 240.

Inner tubular member 242 is prevented from moving appreciably axially downward relative to outer tubular member 244 by a substantially incompressible fluid 250 contained in an annular space 252 between the inner and outer tubular members 242 and 244. Annular space 252 is radially bounded by a polished outer diameter 254 of the inner tubular member 242, and by a polished inner diameter 256 of the outer tubular member 244. Annular space 252 is longitudinally bounded by a shoulder 258 on the outer tubular member 244, and by shoulders 260 and 262 on the inner tubular member 242. Annular space 252 is sealed at its opposite ends by seal 264 disposed in a circumferential groove 266 formed on a radially enlarged portion 268 of the inner tubular member 242, and by seal 270 disposed in a circumferential groove 272 formed on a radially reduced portion 274 of the outer tubular member 244. Seal 264 sealingly engages inner diameter 256 of outer tubular member 244 and seal 270 sealingly engages outer diameter 254 of inner tubular member 242.

A pair of conventional radially extending break plugs 276 having axial apertures 278 extending partially therethrough are threadedly and sealingly installed in threaded holes 280 extending radially through the inner tubular member 242 between the shoulders 260 and 262. The break plugs 276 extend radially from the annular space 252, through the inner tubular member 242, and into a circumferential groove 282 formed on an outer diameter 284 of a ball seat 286. The aperture 278 in each break plug 276 extends from the annular space 252 past the outer diameter 284 of ball seat 286, so that if ball seat 286 moves axially relative to the inner tubular member 242, thereby shearing the break plugs 276 at the outer diameter 284, apertures 278 will form a flow path between the annular space 252 and an inner flow passage 288 extending axially through the inner and outer tubular members 242 and 244.

Coaxially disposed ball seat 286 is prevented from moving axially relative to the inner tubular member 242 by the break plugs 276 which extend radially into groove 282 as described above. Ball seat 286 includes a ball sealing surface 298 disposed on a radially extending and longitudinally sloping upper surface of the ball seat. A seal 290 disposed in a circumferential groove 292 on outer diameter 284 of ball seat 286 sealingly contacts a polished, radially reduced, inner diameter 294 of the inner tubular member 242. When a ball 296 is installed in the inner flow passage 288 above the ball seat 286, a pressure differential may be created across the ball by bringing it into sealing contact with the ball sealing surface 298 (the ball's weight may accomplish this, or flow may be induced in the inner flow passage to move the ball into contact with the ball sealing surface), and applying pressure to the inner flow passage 288 above the ball 296. A downwardly directed axial force will result from the differential pressure across the ball 296. The resulting downwardly directed force will push axially downward on the ball seat 286, and be resisted by the break plugs 276, until the break plugs shear between the inner diameter 294 of the inner tubular member 242 and the outer diameter 284 of the ball seat.

When the break plugs 276 shear, the ball 296 and ball seat 286 are permitted to move axially downward through the inner tubular member 242, and apertures 278 each form a flow path from the annular space 252, through the break plug 276, and into the inner flow passage 288, thereby permitting downward axial movement of the inner tubular member 242 relative to the outer tubular member 244. The weight of the inner tubular member 242 and the equipment attached to the lower end portion 243 will then pull the inner tubular member axially downward, forcing the liquid 250 through the apertures 278 as the volume of the annular space 252 decreases.

Figure 5B:
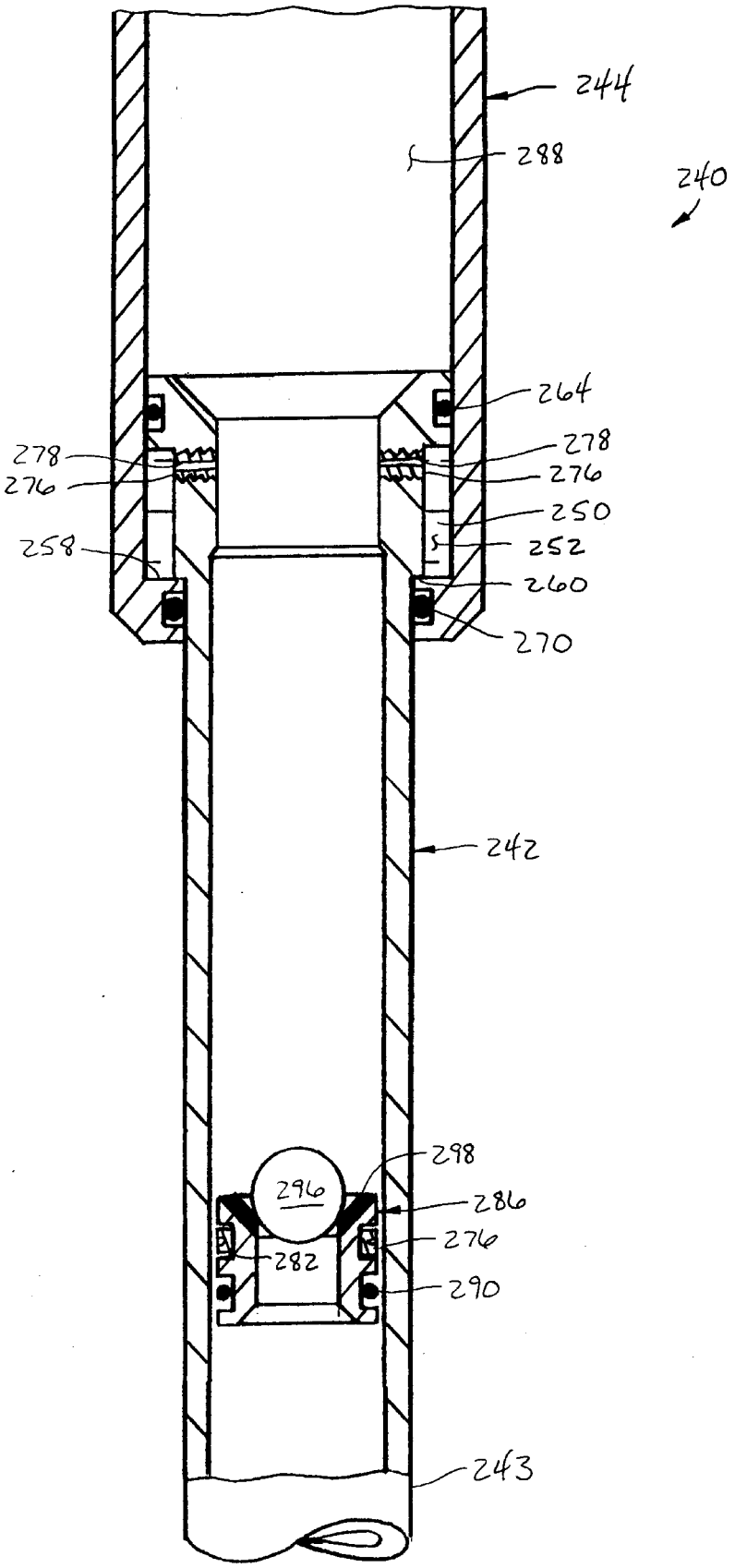
FIG. 5B is a schematicized partially cross-sectional view of the apparatus illustrated in FIG. 5A in an extended configuration thereof.

Illustrated in FIG. 5B is the apparatus 240 of FIG. 5A in an extended configuration thereof. Break plugs 276 have been sheared and the ball 296 and ball seat 286 are permitted to move axially downward through the inner tubular member 242. Substantially all of the liquid 250 has been forced out of the annular space 252, through the apertures 278, and into the inner flow passage 288. The inner tubular member 242 has been forced axially downward relative to the outer tubular member 244 until shoulder 260 contacts shoulder 258, thereby altering the position in the wellbore of the equipment attached to the lower end portion 243 of the inner tubular member.

Figure 6:
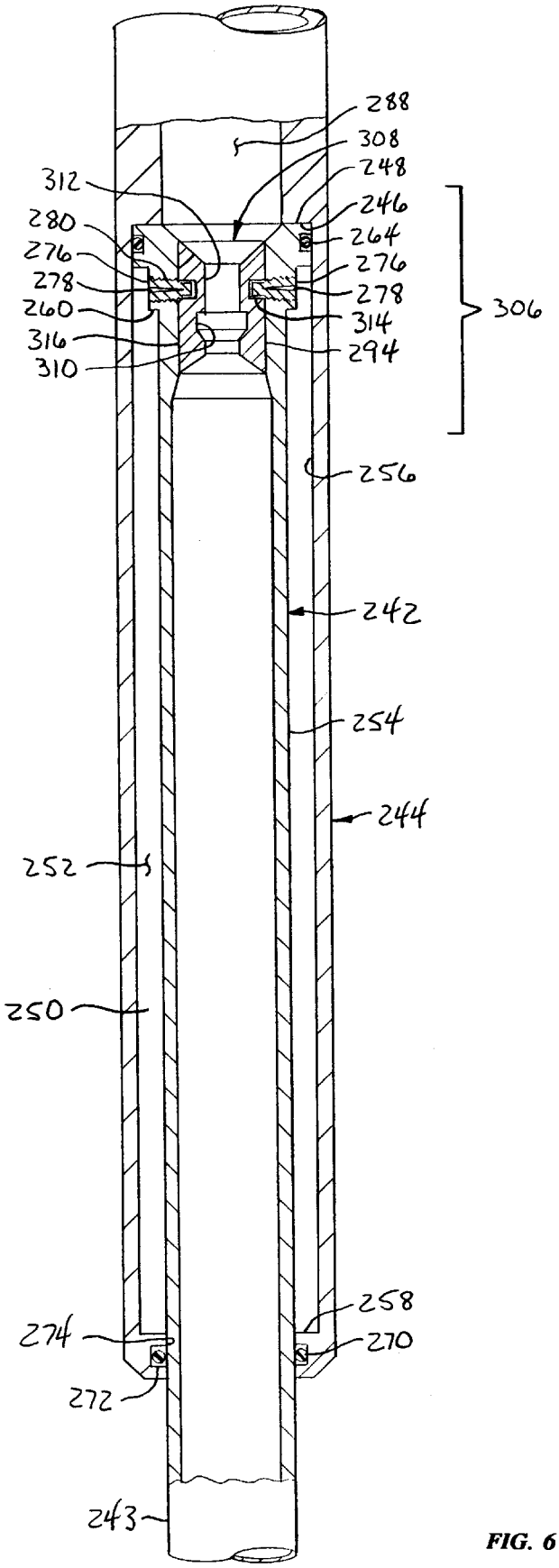
FIG. 6 is a schematicized partially cross-sectional view of yet another wellbore equipment positioning apparatus embodying principles of the present invention.

Turning now to FIG. 6, another release mechanism 306 is shown, which may be utilized in the apparatus 240 of FIG. 5A described hereinabove. For convenience and clarity of the following description of the apparatus 240 and release mechanism 306, some elements shown in FIG. 6 have the same numbers as those elements having substantially similar functions which were previously described in relation to FIGS. 5A and 5B.

In release mechanism 306, a sliding sleeve 308 takes the place of the ball seat 286 shown in FIG. 5A. The sliding sleeve 308 includes a conventional latching profile 310 formed on an inner diameter 312 thereof. Sliding sleeve 308 also includes a circumferential groove 314 formed on an outer diameter 316 thereof.

Break plugs 276 extend radially into the groove 314 and apertures 278 extend radially across the gap between inner diameter 294 of inner tubular member 242 and outer diameter 316 of the sliding sleeve 308. The latch profile 310 permits a conventional latching tool (not shown) to be latched onto the sliding sleeve 308 so that a force may be applied to the sliding sleeve to shear the break plugs 276. The sliding sleeve 308 may be moved axially downward through the inner tubular member 242 after the break plugs 276 have been sheared, or may be moved axially upward through the inner flow passage 288 by the latching tool and extracted at the surface.

As with the embodiment of the apparatus 240 shown in FIG. 5A, when the break plugs 276 are sheared, fluid 250 in annular space 252 is permitted to flow through the apertures 278 and into the inner flow passage 288. The inner tubular member 242 is then permitted to move axially downward relative to the outer tubular member 244.

Note that in the embodiment of the release mechanism 306 illustrated in FIG. 6, there is no seal on the outer diameter 316 of the sliding sleeve 308 comparable to the seal 290 on the outer diameter 284 of the ball seat 286 illustrated in FIG. 5A. This is because the release mechanism 306 requires no pressure differential for its movement. For the same reason, the reduced inner diameter 294 of the inner tubular member 242 does not need to be polished in this embodiment.

Figure 7A:
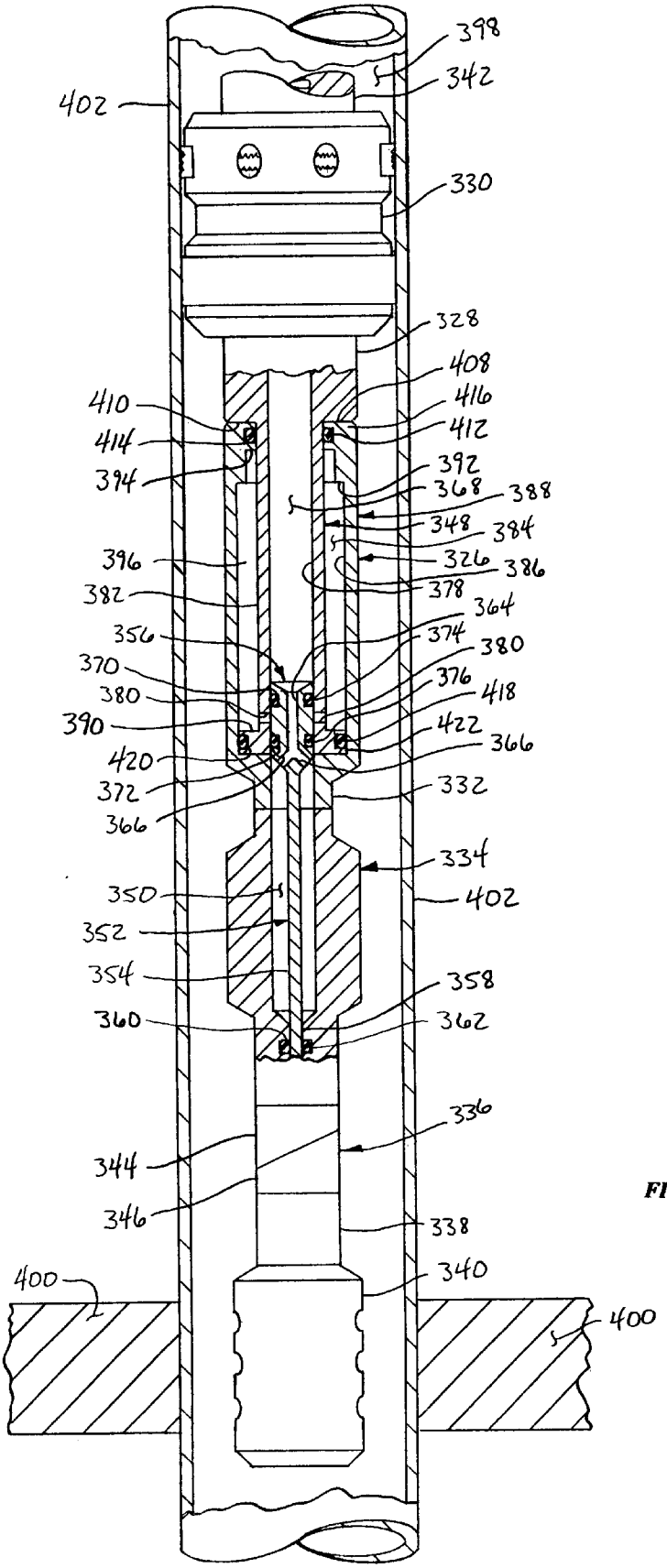
FIG. 7A is a schematicized partially cross-sectional view of yet another wellbore equipment positioning apparatus embodying principles of the present invention in a compressed configuration thereof, and another method of completing a subterranean well embodying principles of the present invention utilizing the apparatus, wherein a perforating gun is positioned opposite a zone to be perforated and produced.

Turning now to FIG. 7A, an apparatus 326 for positioning equipment in a subterranean wellbore 398 is illustrated installed in a tool string 342. The apparatus 326 is shown attached at its upper end 328 to a packer 330, and at its lower end 332 to items of equipment including a sand screen 334, gun release 336, gun firing head 338, and perforating gun 340. The perforating gun 340, firing head 338, and gun release 336 are conventional, other than a modification to a portion of the gun release 336 described hereinbelow. The illustrated gun release 336 is of the type that automatically releases all equipment attached below an inclined muleshoe portion 344 of the gun release when the perforating gun 340 is fired by the firing head 338.

Axially extending from the interior of an inner tubular member 348, through bore 350 of the screen 334, to an attachment point within a lower portion 346 of the gun release 336 is an actuating rod member 352. Lower portion 346 of the conventional gun release 336 is modified to accept attachment of the actuating rod 352 thereto. The actuating rod 352 is attached to the lower portion 346 of the gun release 336 so that when the gun release releases, the actuating rod 352 is pulled downward with the rest of the equipment.

Actuating rod 352 includes a polished cylindrical lower portion 354, which is the portion of the actuating rod which is attached to the lower portion 346 of the gun release 336 as described above, and a radially enlarged head portion 356, which extends coaxially into a lower interior portion of the inner tubular member 348. Between the bore 350 of the screen 334 and the muleshoe portion 344 of the gun release 336, the rod lower portion 354 extends axially through a radially reduced inner diameter 358 of the screen 334. The inner diameter 358 is slightly larger than the diameter of the rod lower portion 354 and includes a circumferential groove 360. A seal 362 disposed in the groove 360 sealingly engages the rod lower portion 354.

An axial flow port 364 extends from an upper surface of the rod head portion 356 axially downward into the head portion and intersects a pair of axially inclined and radially extending flow ports 366 which extend from a lower surface of the head portion. The axial and radial flow ports 364 and 366 provide fluid and pressure communication between the bore of the screen 350 and an axial inner flow passage 368 in the inner tubular member 348 above the head portion 356.

Head portion 356 is radially enlarged as compared to the rod lower portion 354 and includes a pair of longitudinally spaced apart circumferential grooves 370 and 372. Seals 374 and 376 are disposed in the grooves, 370 and 372 respectively, and sealingly engage a polished inner diameter 378 of the inner tubular member 348. Seals 374 and 376 straddle a pair of ports 380 radially extending through the inner tubular member 348 from inner diameter 378 to a polished outer diameter 382 of the inner tubular member. The ports 380 provide fluid communication between an annular chamber 384 and the inner flow passage 368 when the actuating rod 352 is moved axially downward relative to the inner tubular member 348 after the gun 340 fires and the gun release 336 releases as further described hereinbelow.

The annular chamber 384 extends radially between the outer diameter 382 of the inner tubular member 348 and a polished inner diameter 386 of an outer tubular member 388. Outer tubular member 388 is in a coaxial telescoping and overlapping relationship to the inner tubular member 348. Seal 412 is disposed in a circumferential groove 414 formed on a radially reduced upper portion 416 of the outer tubular member 388 and is in sealing engagement with the outer diameter 382 of the inner tubular member 348. Seal 418 is disposed in a circumferential groove 420 formed on a lower radially enlarged portion 422 of the inner tubular member 348 and is in sealing engagement with the inner diameter 386 of the outer tubular member 388.

The annular chamber 384 extends longitudinally between a shoulder 390 on the inner tubular member 348 to shoulders 392 and 394 on the outer tubular member 388. The annular chamber 384 is substantially filled with a substantially incompressible fluid 396, for example, oil or silicone fluid. The fluid 396 does not permit the outer tubular member 388 to move appreciably axially downward relative to the inner tubular member 348, and shoulder 408 on the inner tubular member 348, in contact with shoulder 410 on the outer tubular member, prevents the outer tubular member from moving upward relative to the inner tubular member. When, however, the ports 380 are no longer straddled by the seals 374 and 376, the fluid 396 may pass from the annular chamber 384, through the ports 380, and into the inner flow passage 368 and thereby permit the outer tubular member 388 to move axially downward relative to the inner tubular member 348.

FIG. 7A shows the tool string 342 positioned in the wellbore 398 with the guns 340 positioned longitudinally opposite a potentially productive formation 400 and the packer 330 set in protective casing 402. The function of the apparatus 326 in the illustrated embodiment is to position the screen 334 opposite the formation 400 automatically after the gun 340 has perforated the casing 402. The operation of the automatic gun release 336 in releasing all equipment attached below it after the gun 340 has fired is utilized to exert an axially downward pull on the actuator rod 352 and thereby uncover the ports 380 so that the outer tubular member 388 is permitted to move axially downward relative to inner tubular member 348.

Figure 7B:
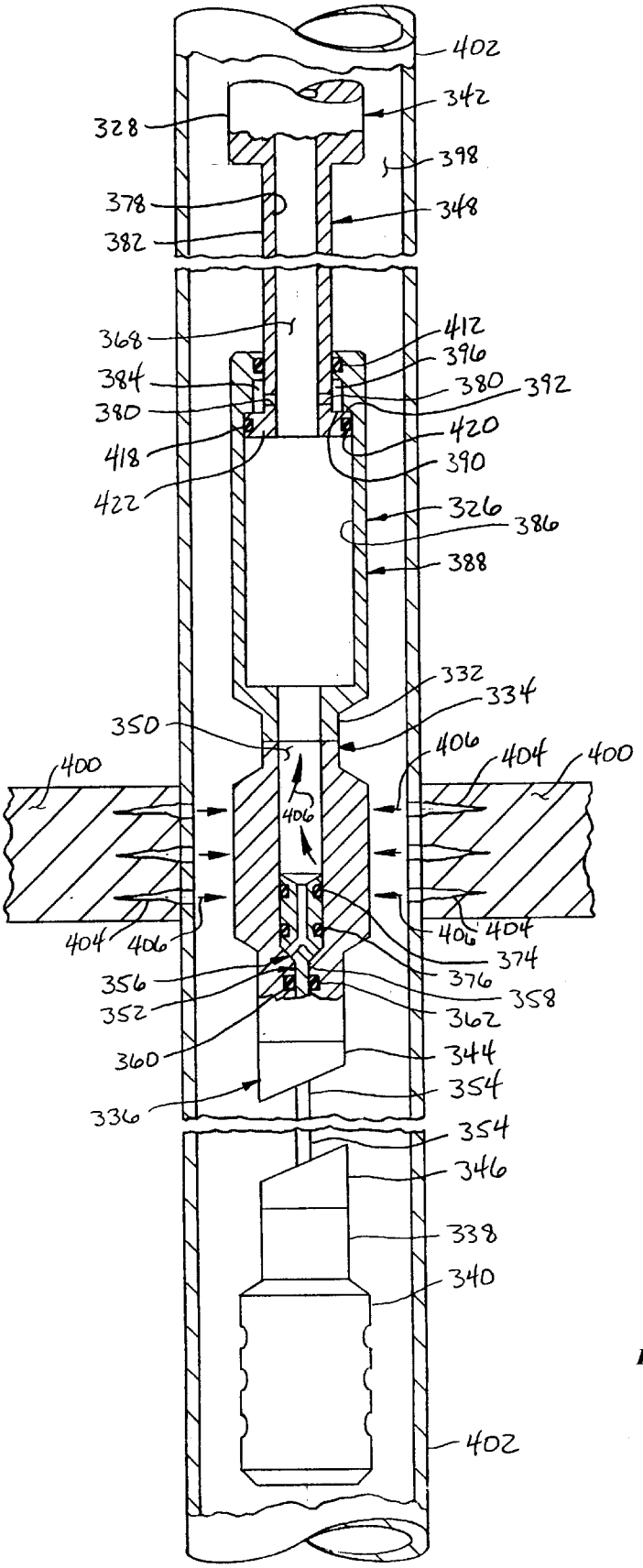
FIG. 7B is a schematicized partially cross-sectional view of the wellbore equipment positioning apparatus illustrated in FIG. 7A in an extended configuration thereof, and the method illustrated in FIG. 7A wherein the zone has been perforated and a screen positioned opposite the producing zone.

FIG. 7B shows the tool string 342, including the apparatus 326, shown in FIG. 7A in the wellbore 398 after the gun 340 has fired, forming perforations 404 which extend radially through the casing 402 and into the formation 400. Gun release 336 has released, permitting the lower portion 346, firing head 338, and gun 340 to drop longitudinally downward in the wellbore 398, causing a downward pull to be exerted on the lower portion 354 of the actuating rod 352.

Due to the downward pull on the actuating rod 352, head portion 356 has been moved axially downward such that it is no longer in the interior of the inner tubular member 348, but is in a lower portion of the bore 350 of the screen 334. Seals 374 and 376 no longer straddle the ports 380, therefore, fluid communication has been established between the annular chamber 384 and the inner flow passage 368. Substantially all of the fluid 396 has been forced out of the annular chamber 384 due to the annular chamber's decreased volume.

Shoulder 392 contacts shoulder 390, preventing further axially downward movement of the outer tubular member 388 relative to the inner tubular member 348. In the extended configuration of the apparatus 326 illustrated in FIG. 7B, the screen 334 is now positioned longitudinally opposite the formation 400 and formation fluids 406 may now flow directly from the formation, through the perforations 404, and into the bore 350 of the screen 334. Note that the screen 334 was positioned opposite the formation 400, displacing the gun 340, automatically after the gun was fired.

It is to be understood that although FIG. 7B shows the rod lower portion 354 remaining attached to the gun release lower portion 346, the rod lower portion 354 may be detached from the gun release lower portion 346, thereby allowing the gun 340, firing head 338, and gun release lower portion 346 to drop to the bottom of the wellbore 398, without deviating from the principles of the present invention. It is also to be understood that the rod lower portion 354 may be detached from the rod head portion 356 after the gun release 336 has released, thereby allowing the rod lower portion 354 to drop to the bottom of the wellbore 398 along with the gun 340, firing head 338, and gun release lower portion 346 without deviating from the principles of the present invention.

Figure 8A:
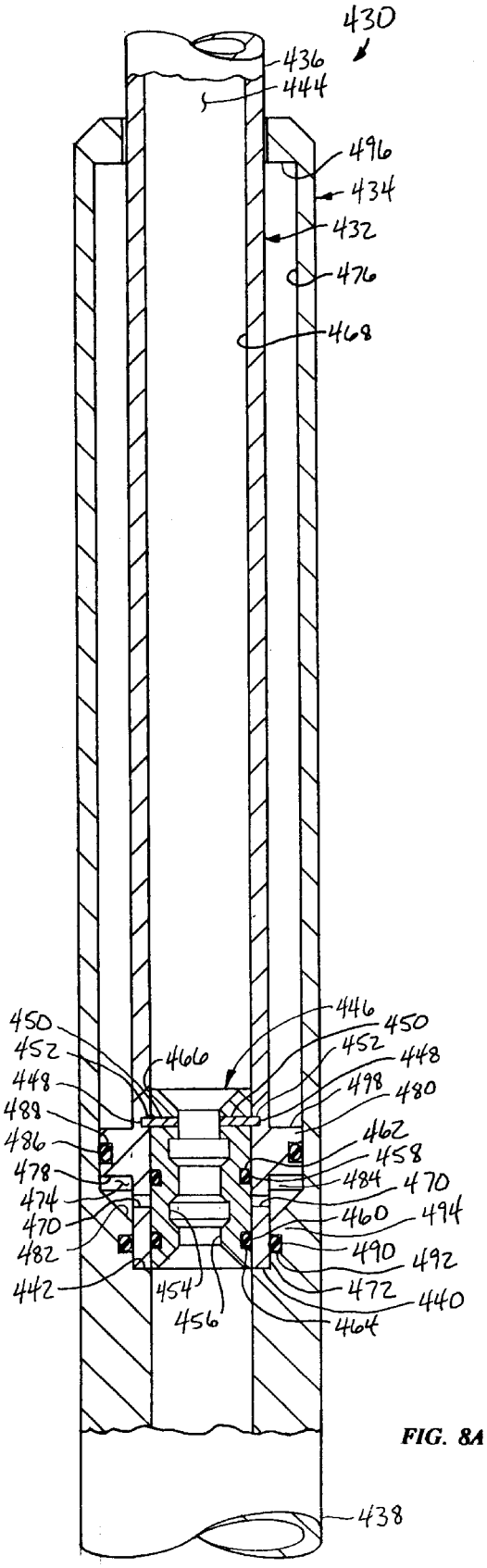
FIG. 8A is a schematicized partially cross-sectional view of yet another wellbore equipment positioning apparatus embodying principles of the present invention in a compressed configuration thereof.

Illustrated in FIG. 8A is an apparatus 430 for positioning equipment in a wellbore. The apparatus 430 includes inner and outer coaxial telescoping tubular members, 432 and 434 respectively. As shown in FIG. 8A, the apparatus 430 is configured in an axially compressed position wherein the outer tubular member 434 substantially overlaps the inner tubular member 432. In the compressed position, the distance between upper end portion 436 and lower end portion 438 of the apparatus 430 is minimized. The upper end portion 436 is preferably attached to a device for preventing axial movement of the apparatus 430 in the wellbore, such as a packer, and lower end portion 438 is preferably attached to the equipment. Shoulder 440 on the outer tubular member 434, in contact with shoulder 442 on the inner tubular member 432, prevents further axial compression of the apparatus 430.

Axial flow passage 444 extends through the apparatus 430 providing fluid and pressure communication between the upper end portion 436 and the lower end portion 438. A tubular sliding sleeve 446 axially disposed within the flow passage 444 is secured to the inner tubular member 432 by means of shear pins 448. Each of the shear pins 448 are installed in holes 450, which extend radially through the sliding sleeve 446, and holes 452, which extend radially into, but not through, the inner tubular member 432. A conventional latching profile 454 is formed on inner diameter 456 of the sliding sleeve 446, so that a conventional latching tool (not shown) may be latched into the latching profile 454 in order to apply a predetermined axial force to the shifting sleeve 446 to shear the shear pins 448.

Seals 458 and 460 are disposed in longitudinally spaced apart circumferential grooves, 462 and 464 respectively, formed on outer diameter 466 of the sliding sleeve 446, and sealingly engage a polished inner diameter 468 of the inner tubular member 432. Seals 458 and 460 straddle ports 470 and prevent fluid communication between the ports and the flow passage 444. Ports 470 extend radially through the inner tubular member 432 from inner diameter 468 to a polished outer diameter 472 of the inner tubular member.

The ports 470 are in fluid communication with an annular chamber 474. The annular chamber 474 extends radially from outer diameter 472 of the inner tubular member 432 to a polished inner diameter 476 of the outer tubular member 434. The annular chamber 474 extends longitudinally from shoulder 478 on a radially enlarged portion 480 of inner tubular member 432 to radially extending and longitudinally sloping shoulder 482 on the outer tubular member 434. A substantially inexpandable fluid 484 substantially fills the annular chamber 474.

Seal 486, disposed in circumferential groove 488 formed on the radially enlarged portion 480 of the inner tubular member 432, sealingly contacts the inner diameter 476 of the outer tubular member 434. Seal 490, disposed in circumferential groove 492 formed on radially reduced portion 494 of the outer tubular member 434, sealingly contacts the outer diameter 472 of the inner tubular member 432.

The outer tubular member 434 is not permitted to move appreciably axially downward relative to the inner tubular member 432 because such movement would require an increase in the volume of the annular chamber 474. Since the annular chamber 474 is sealed and the fluid 484 therein is substantially inexpandable, the volume of the annular chamber cannot be appreciably increased. When, however, the shear pins 448 are sheared and the sliding sleeve 446 is axially displaced such that seals 458 and 460 no longer straddle the ports 470, the annular chamber 474 is in fluid communication with the flow passage 444 and fluid may enter the annular chamber 474 so that it is permitted to expand.

Figure 8B:
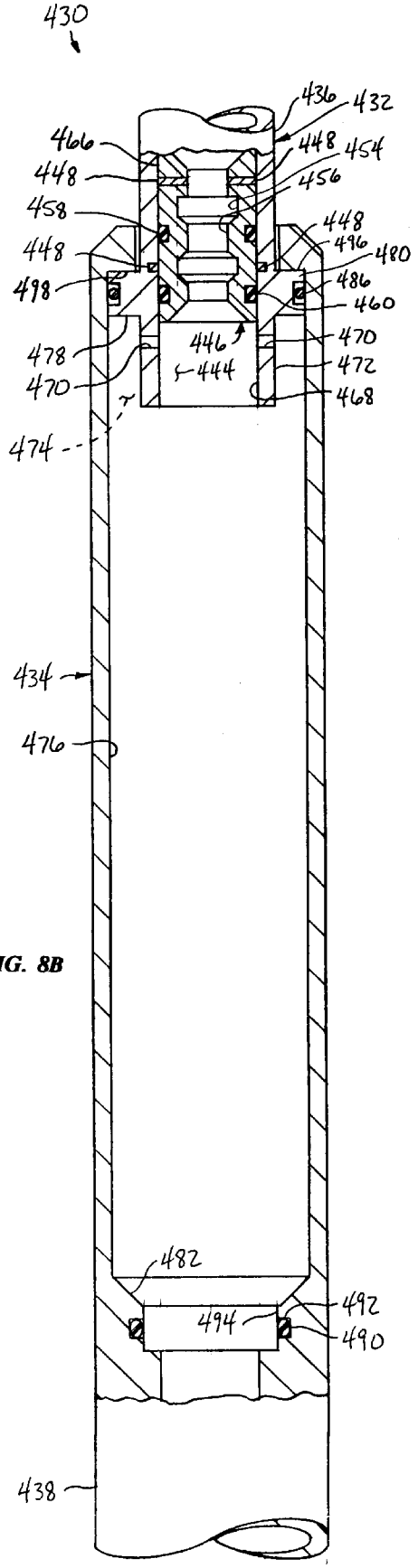
FIG. 8B is a schematicized partially cross-sectional view of the apparatus illustrated in FIG. 8A in an extended configuration thereof.

FIG. 8B shows the apparatus 430 illustrated in FIG. 8A in an extended configuration thereof. A conventional latching or shifting tool (not shown) has been latched into the latching profile 454 in the sliding sleeve 446 and the predetermined forced applied to shear the shear pins 448 and move the sliding sleeve axially upward so that seals 458 and 460 no longer straddle the ports 470.

Fluid communication has been established between the flow passage 444 and the ports 470, thereby permitting the annular chamber 474 to expand volumetrically. Outer diameter 472 of inner tubular member 432 is no longer within the reduced portion 494 of the outer tubular member 434, therefore, the outer diameter 472 no longer forms a boundary of the annular chamber 474 and the annular chamber essentially ceases to exist.

The outer tubular member 434 is permitted to move axially downward relative to the inner tubular member 432 until shoulder 496 on the outer tubular member contacts shoulder 498 on the inner tubular member. The equipment attached to the lower end portion 438 is, thus, moved longitudinally downward in the wellbore relative to the upper end portion 436 of the apparatus 430.

Figure 9A:
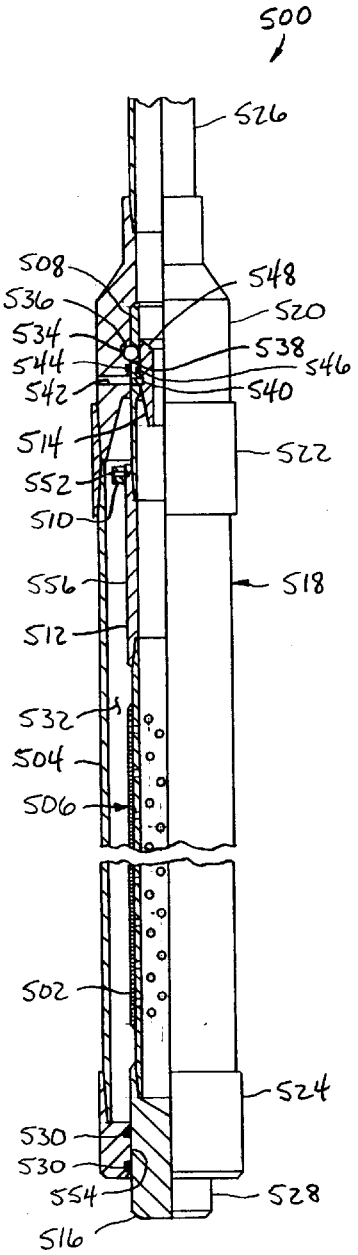
FIG. 9A is a schematicized partially cross-sectional view of still another wellbore equipment positioning apparatus embodying principles of the present invention in a compressed configuration thereof.

Turning now to FIG. 9A, a wellbore equipment positioning apparatus 500 embodying principles of the present invention is representatively illustrated. As shown in FIG. 9A, the apparatus 500 is in its compressed configuration, a tubular and axially extending sand control screen 502 being telescopingly disposed within an outer axially extending tubular member 504. Thus, with the apparatus 500 in its compressed configuration, the screen 502 is radially outwardly overlapped by the tubular member 504.

The screen 502 forms a portion of an inner axially extendable tubular assembly 506. Other components of the inner assembly 506 include a releasing sleeve 508, a stop ring 510, an upper mandrel 512, a ball seat 514, and a lower mandrel 516. The screen 502, releasing sleeve 508, upper mandrel 512, and lower mandrel 516 are threadedly attached to each other.

The outer tubular member 504 likewise forms a portion of an outer tubular assembly 518. Other components of the outer assembly 518 include a releasing head 520, a threaded collar 522, and a lower retainer 524. The outer tubular member 504, releasing head 520, collar 522, and lower retainer 524 are threadedly attached to each other.

In a preferred construction of the apparatus 500, the releasing head 520 is internally threaded for attachment to production tubing 526 (e.g., conventional 3½" NU tubing), and is externally threaded for attachment to the collar 522. In the preferred construction, the collar 522 is a conventional 7" casing collar, the outer tubular member 504 is a conventional 7" casing, and the lower retainer 524 is a modified conventional 7" casing shoe.

Figure 9B:
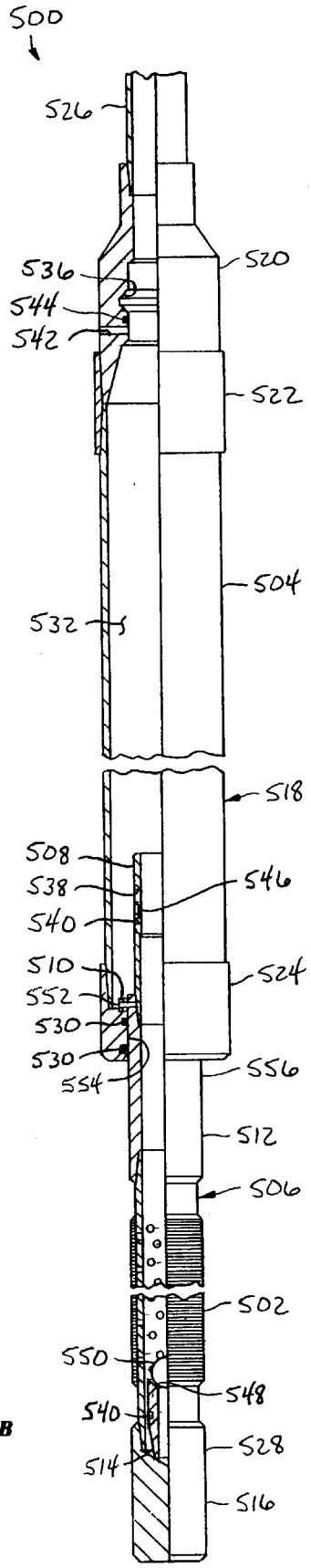
FIG. 9B is a schematicized partially cross-sectional view of the apparatus illustrated in FIG. 9A in an extended configuration thereof.

In its compressed configuration, the apparatus 500 affords protection to the screen 502 disposed within the outer assembly 518. Thus, when the apparatus 500 is run into a wellbore, for example, suspended from tubing 526, debris, paraffin, etc. in the wellbore is prevented from contacting the screen 502 by the outer assembly 518 outwardly surrounding the inner assembly 506. In another manner of using the apparatus 500, after the apparatus has been placed in its extended configuration as shown in FIG. 9B, the outer assembly 518 may be lowered to again outwardly surround the inner assembly 506, so that remedial operations, such as screen washing, may be performed with the screen 502 protected by the outer assembly 518.

The lower mandrel 516 is axially slidably disposed within the lower retainer 524. A polished outer surface 528 of the lower mandrel 516 is sealingly engaged by seals 530 internally carried on the lower retainer 524. This sealing engagement prevents fluid communication between the wellbore and the interior 532 of the apparatus 500.

The apparatus 500 is maintained in its compressed configuration by cooperative engagement between a series of circumferentially spaced apart balls 534 and an internally formed groove 536 on the releasing head 520. The balls 534 extend radially through holes 538 formed radially through the releasing sleeve 508, and are outwardly supported by the ball seat 514.

The ball seat 514 is maintained in its position radially aligned with the balls 534 by a shear screw 540 threadedly installed radially through the releasing sleeve 508 and into the ball seat. Note that the shear screw 540 is installed through a hole 542 formed radially through the releasing head 520. Thus, the balls 534 prevent relative axial displacement between the releasing sleeve 508 and the releasing head 520, and the shear screw 540 prevents relative axial displacement between the ball seat 514 and the releasing sleeve.

A seal 544 internally carried on the releasing head 520 sealingly engages the releasing sleeve 508, and a seal 546 internally carried on the releasing sleeve 508 sealingly engages the ball seat 514. The ball seat 514 has an upper inclined ball seal surface 548 formed thereon for sealing engagement with a ball 550 (see FIG. 9B). When it is desired to axially outwardly extend the inner assembly 506 from within the outer assembly 518, the ball 550 may be dropped through the tubing 526 at the earth's surface, so that the ball sealingly engages the ball seal surface 548. Fluid pressure may then be applied to the tubing 526 at the earth's surface to shear the shear screw 540, thereby permitting the ball 550 and ball seat 514 to be axially downwardly displaced relative to the releasing sleeve 508 and permitting the balls 534 to radially inwardly disengage from the groove 536.

Referring additionally now to FIG. 9B, the apparatus 500 is representatively illustrated in its extended configuration. The ball 550 has sealingly engaged the ball seal surface 548, and the shear screw 540 has been sheared by application of pressure to the tubing 526. The ball and ball seat 514 are now disposed adjacent the lower mandrel 516.

The axially downward displacement of the ball seat 514 relative to the releasing sleeve 508 has permitted the balls 534 to radially inwardly displace and disengage from the groove 536. Thus, the releasing sleeve 508 and the remainder of the inner assembly 506 have been permitted to axially downwardly displace relative to the releasing head 520 and the remainder of the outer assembly 518. Note that the screen 502 is now exposed to the wellbore and is in an advantageous position for screening production fluids flowing from the wellbore to the interior 532 of the apparatus 500 and through the tubing 526 to the earth's surface.

In the extended configuration of the apparatus 500 as representatively illustrated in FIG. 9B, the inner assembly 506 is prevented from further axially downward displacement relative to the outer assembly 518 by the stop ring 510 externally disposed on the upper mandrel 512. The stop ring 510 is secured to the upper mandrel 512 by a shear pin 552 installed radially through the stop ring and into the upper mandrel 512. The stop ring 510 is radially enlarged relative to a bore 554 formed axially through the lower retainer 524.

If it should become desirable to retrieve the outer assembly 518 from the wellbore without also retrieving the inner assembly 506 (such as, if the inner assembly became stuck in the wellbore), a sufficient axially upwardly directed force may be applied to the tubing 526 at the earth's surface to shear the shear pin 552. In this manner, the outer assembly 518 may be disengaged from the inner assembly 506 and removed from its outwardly disposed relationship with the inner assembly, and the inner assembly may be separately retrieved from the wellbore.

With the apparatus 500 in its extended configuration as shown in FIG. 9B, an outer polished surface 556 on the upper mandrel 512 is axially sealingly received in the lower retainer 524. Thus, fluid flow from the wellbore to the interior 532 of the apparatus 500 is directed through the screen 502 for screening of sand, debris, etc. therefrom.

If it is desired to again outwardly surround the screen 502 with the outer tubular member 504, or to prevent fluid communication between the interior 532 and the wellbore, the outer assembly 518 may be axially downwardly displaced relative to the inner assembly 506. For prevention of the fluid communication, the outer assembly 518 may be sufficiently downwardly displaced relative to the inner assembly 506 so that the seals 530 again sealingly engage the lower mandrel 516.

In a preferred method of using the apparatus 500, the apparatus is run into the wellbore suspended from the tubing 526, the apparatus being in its compressed configuration as shown in FIG. 9A. The tubing 526 and apparatus 500 are lowered until the lower mandrel 516 touches the bottom of the wellbore. The ball 550 is then dropped through the tubing 526 from the earth's surface and pressure is applied to the tubing to shear the shear screw 540. The tubing 526 and outer assembly 518 are then raised, the inner assembly 506 remaining at the bottom of the wellbore, until the apparatus 500 is in its extended configuration as shown in FIG. 9B. In this way, the screen 502 may be run, set, and put into production in one trip into the wellbore. The screen 502 may be advantageously run into wellbores of questionable cleanliness and without concern regarding debris, paraffin, etc. in the wellbores which might otherwise contaminate or damage the screen.

Note that equipment operatively positionable in the wellbore other than the screen 506 may be utilized in the apparatus 500. For example, a perforating gun may be utilized in place of, or in addition to, the screen 502 in the inner assembly 506.

It is to be understood that, although various embodiments of apparatus for positioning equipment in a wellbore described hereinabove which include a release mechanism actuatable by pressure applied to an inner flow passage above a ball are not also illustrated as including a latching profile for mechanical actuation of the release mechanism, such inclusion of a latching profile in each of the disclosed embodiments is contemplated by the inventors. An embodiment of the present invention having a release mechanism which is actuatable by both direct application of force via a latching tool latched into a latching profile and by application of pressure after installing a ball is specifically illustrated in FIGS. 1A and 1B. Therefore, a latching profile for mechanical actuation of the release mechanism may be included in each of the above disclosed embodiments without departing from the principles of the present invention.

The foregoing detailed description is to be clearly understood as being given by way of illustration and example only, the spirit and scope of the present invention being limited solely by the appended claims.

What is claimed is:

1. Apparatus for releasably securing a first tubular member to an overlapping and coaxially disposed second tubular member, the apparatus comprising:

a frangible member, the frangible member releasably securing the first tubular member against axial movement relative to the second tubular member, such that the frangible member must be broken to permit axial movement of the first tubular member relative to the second tubular member;

an annular gap between the first and second tubular members;

a seal disposed in the annular gap sealingly engaging the first and second tubular members;

a piston capable of breaking the frangible member in response to a first predetermined pressure and axially moving the first tubular member relative to the second tubular member after the frangible member is broken; and a latching profile formed on an interior surface of the first tubular member, the latching profile being internally engageable by a shifting tool, whereby axial force may be applied to the first tubular member, after engaging the shifting tool with the latching profile, to break the frangible member and move the first tubular member axially relative to the second tubular member.

2. The apparatus according to claim 1, further comprising a first aperture formed on an exterior surface of the first tubular member, and a second aperture formed on an interior surface of the second tubular member opposite the first aperture and aligned therewith; and wherein the frangible member comprises a shear pin extending laterally into the first and second apertures.

3. Apparatus for releasably securing a first tubular member to an overlapping and coaxially disposed second tubular member, the apparatus comprising:

a frangible member, the frangible member releasably securing the first tubular member against axial movement relative to the second tubular member, such that the frangible member must be broken to permit axial movement of the first tubular member relative to the second tubular member;

an annular zap between the first and second tubular members;

a seal disposed in the annular gap sealingly engaging the first and second tubular members; and a piston capable of breaking the frangible member in response to a first predetermined pressure and axially moving the first tubular member relative to the second tubular member after the frangible member is broken, the piston including a ball sealing surface operatively disposed within the first tubular member, the ball sealing surface being capable of sealingly engaging a ball, and the ball sealing surface having an inner diameter less than an outer diameter of the ball, and the piston further including a ball seat capable of expanding the ball sealing surface, such that the ball sealing surface inner diameter becomes greater than the ball outer diameter, in response to a second predetermined pressure greater than the first predetermined pressure.

4. Apparatus for positioning equipment in a subterranean well, the apparatus comprising:

a telescoping member having first and second opposite ends, the telescoping member being extendable from a first length to a second length, the second opposite end being attached to the equipment, the telescoping member including a first tubular member and an overlapping and coaxially disposed second tubular member, an annular gap between the first and second tubular members, and a seal disposed in the annular gap sealingly engaging the first and second tubular members;

a latch attached to the telescoping member for latching the telescoping member at the first length, the latch being operative to release the telescoping member for extension thereof when a first predetermined pressure is apllied to the latch, the latch including a frangible member securing the first tubular member against axial movement relative to the second tubular member, such that the frangible member must be broken to permit axial movement of the first tubular member relative to the second tubular member;

a hydraulic extension device attached to the telescoping member for extending the telescoping member from the first length to the second length after the first predetermined pressure is applied to the latch;

an anchor, the anchor securing the telescoping member first opposite end against longitudinal movement in the wellbore; and an expandable ball sealing surface operatively disposed within the first tubular member, the ball sealing surface being capable of sealingly engaging a ball, and the ball sealing surface having an inner diameter less than an outer diameter of the ball, such that in response to a second predetermined pressure greater than the first predetermined pressure the ball sealing surface inner diameter becomes greater than the ball outer diameter, whereby, when the first predetermined pressure is applied to the latch, the hydraulic extension device may conveniently extend the telescoping member to position the equipment in the wellbore.

5. Apparatus for positioning equipment in a subterranean wellbore, the apparatus comprising:

a telescoping member having first and second opposite ends, the telescoping member being extendable from a first length to a second length, the first opposite end being securable against longitudinal movement in the wellbore, and the second opposite end being attached to the equipment;

a release mechanism attached to the telescoping member for releasably securing the telescoping member at the first length, the release mechanism being operative to release the telescoping member for extension thereof when a first predetermined force is applied to the release mechanism, the release mechanism including a frangible member securing the telescoping member against extension thereof, such that the frangible member must be broken to permit extension of the telescoping member, an annular gap disposed in the telescoping member, a seal disposed in the annular gap sealingly engaging the first and second tubular members, and a ball sealing surface operatively disposed within the telescoping member, the ball sealing surface being capable of sealingly engaging a ball for application of a first predetermined pressure thereacross, and the ball sealing surface having an inner diameter less than an outer diameter of the ball, such that, when the first predetermined pressure is applied across the ball, the first predetermined force is produced in the telescoping member, and the ball sealing surface being expandable, such that the ball sealing surface inner diameter becomes greater than the ball outer diameter when a second predetermined pressure greater than the first predetermined pressure is applied across the ball; and a hydraulic extending piston attached to the telescoping member, the hydraulic extending piston being operative to extend the telescoping member from the first length to the second length after the first predetermined force is applied to the release mechanism, whereby, when the first predetermined force is applied to the release mechanism, the telescoping member may extend to position the equipment in the wellbore.

6. Apparatus for completing a subterranean well, the apparatus comprising:

a packer, the packer being capable of being set in the well;

first and second items of equipment; and a force activatable telescoping member attached to the packer and the first and second items of equipment, the telescoping member being capable of moving the first and second items of equipment relative to the packer while the packer is set in the well in response to force applied to the telescoping member, whereby the first and second items of equipment may be moved relative to the packer by applying force to the telescoping member while the packer is set in the well.

7. The apparatus according to claim 6, wherein:

the telescoping member comprises an expansion joint having first and second opposite ends, the expansion joint being extendable from a first length to a second length, the second length being greater than the first length, a latch attached to the expansion joint and latching the expansion joint at the first length, the latch being operative to release the expansion joint for extension thereof when a first predetermined pressure is applied to the latch.

8. The apparatus according to claim 7, further comprising a hydraulic extension device attached to the telescoping member for extending the telescoping member from the first length to the second length after the first predetermined pressure is applied to the latch.

9. The apparatus according to claim 7, wherein:

the telescoping member further comprises a ball having a diameter, a tubular member having a first inner diameter, a hollow cylindrical piston disposed in the tubular member, the piston having an inner diameter greater than the ball diameter, a first outer diameter slightly smaller than the tubular member first inner diameter, and a seal for sealing between the piston first outer diameter and the tubular member first inner diameter, a first shear member releasably securing the piston against movement relative to the tubular member, and a pressure activated ball release attached to the piston, the ball release being configured to release the ball after the piston has moved relative to the tubular member.

10. The apparatus according to claim 9, wherein:

the tubular member further comprises a polished bore receptacle having opposite ends, one of the opposite ends being attached to the packer, and a second inner diameter smaller than the piston first outer diameter proximate the other of the opposite ends; and the piston further comprises first and second portions, the first portion having the first outer diameter thereon and being disposed in the tubular member between the packer and the tubular member second inner diameter, and the second portion having a second outer diameter smaller than the tubular member second inner diameter, the piston second portion extending outwardly from the tubular member and being attached to the sand control screen.

11. The apparatus according to claim 9 wherein:

the pressure activated ball release comprises a hollow cylindrical sleeve having first and second inner diameters and an expandable annular ring, the ring being disposed in the sleeve and having a first inside diameter smaller than the ball diameter when disposed in the sleeve first inner diameter and a second inside diameter greater than the ball diameter when disposed in the sleeve second inner diameter, the ring further having opposite ends and a ball sealing surface on one of the opposite ends, whereby, when the ring is disposed in the sleeve first inner diameter, the ball may not pass through the ring but seals against the ball sealing surface, and when the ring is disposed in the sleeve second inner diameter, the ball is permitted to pass through the ring.

12. The apparatus according to claim 9, wherein:

the first shear member comprises a shear pin;

the pressure activated ball release comprises a ball seat capable of releasably capturing the ball, a ball sealing surface, the ball sealing surface permitting pressure to be applied across the ball, and a second shear member for releasing the ball when a second predetermined pressure has been applied across the ball; and the ball seat and the ball sealing surface being attached to the sleeve such that when a first pressure differential is applied across the ball the sleeve is biased to move from the first position to the second position, whereby, when the ball is captured by the ball seat and pressure is permitted to be applied across the ball by the ball sealing surface, the first predetermined pressure may be applied across the ball to move the sleeve from the first position to the second position and the piston is thereby permitted to move relative to the tubular member, and the second predetermined pressure may be applied across the ball to release the ball.

13. The apparatus according to claim 7, wherein:

the expansion joint comprises a first tubular member and an overlapping and coaxially disposed second tubular member; and the latch comprises:

a frangible member for securing the first tubular member against axial movement relative to the second tubular member, such that the frangible member must be broken to permit axial movement of the first tubular member relative to the second tubular member, an annular gap between the first and second tubular members, and a seal disposed in the annular gap sealingly engaging the first and second tubular members.

14. The apparatus according to claim 13, further comprising a first aperture formed on an exterior surface of the first tubular member, and a second aperture formed on an interior surface of the second tubular member opposite the first aperture and aligned therewith; and wherein the frangible member comprises a shear pin, the shear pin extending laterally into the first and second apertures.

15. The apparatus according to claim 13, wherein the latch further comprises a ball sealing surface operatively disposed within the first tubular member, the ball sealing surface being capable of sealingly engaging a ball, the ball sealing surface having an inner diameter less than an outer diameter of the ball, and the ball sealing surface further being radially expandable, such that the ball sealing surface inner diameter becomes greater than the ball outer diameter in response to a second predetermined pressure greater than the first predetermined pressure.

16. The apparatus according to claim 6, wherein the first item of equipment is a perforating gun and the second item of equipment is a sand screen.

17. A method of repositioning equipment in a subterranean well, the method comprising the steps of:

providing an expansion joint, the expansion joint being expandable from a first compressed position to a second expanded position thereof;

providing a release device for securing the expansion joint in the first compressed position until the release device is activated to release the expansion joint for expansion to the second expanded position thereof, the release device including a frangible member for securing the expansion joint against expansion thereof, such that the frangible member must be broken to permit expansion of the expansion joint, an annular gap disposed in the expansion joint, a seal disposed in the annular gap sealingly engaging the expansion joint and isolating an interior flow passage within the expansion joint from the well exterior to the expansion joint, and a ball sealing surface operatively disposed within the expansion joint, the ball sealing surface being capable of sealingly engaging a ball for application of a first predetermined pressure thereacross, and the ball sealing surface having an inner diameter less than an outer diameter of the ball;

providing a force responsive activating device for activating the release device to release the expansion joint;

attaching the equipment to the expansion joint;

attaching the release device to the expansion joint;

attaching the force responsive activating device to the release device;

inserting the equipment, the expansion joint, and the force responsive activating device into the well;

activating the activating device by applying a first predetermined force to the activating device;

expanding the expansion joint to the second expanded position thereof; and expanding the ball sealing surface, such that the ball sealing surface inner diameter is greater than the ball outer diameter, by applying a second predetermined pressure greater than the first predetermined pressure across the ball, whereby, when the expansion joint is expanded to the second expanded position thereof, the equipment is repositioned in the well.

18. Method of completing a subterranean well, the well having a wellbore and a formation, the formation being intersected by the wellbore, the method comprising the steps of:

providing first and second items of equipment;

providing a pressure activatable device capable of displacing the first and second items of equipment from a first position in which the first item of equipment is opposite the formation to a second position in the well, the pressure activatable device including an expandable ball sealing surface;

attaching the first and second items of equipment to the pressure activatable device;

inserting the first and second items of equipment and the pressure activatable device in the well;

aligning the first item of equipment opposite the formation in the first position;

activating the pressure activatable device to displace the first and second items of equipment to the second position by applying a first predetermined pressure to the pressure activatable device; and applying a second predetermined pressure to the pressure activatable device to thereby expand the expandable ball sealing surface.

19. The method according to claim 18, further comprising the steps of:

providing a packer;

attaching the packer to the pressure activatable device;

inserting the packer in the well; and setting the packer in the well before the step of activating the pressure activatable device.

20. The method according to claim 18, wherein the pressure activatable device providing step comprises the steps of:

providing a first tubular member releasably secured to an overlapping and coaxially disposed second tubular member;

providing a frangible member;

securing the first tubular member against axial movement relative to the second tubular member, such that the frangible means must be broken to permit axial movement of the first tubular member relative to the second tubular member;

providing an annular gap between the first and second tubular members;

disposing a seal in the annular gap, the seal sealingly engaging the first and second tubular members; and providing a piston configured to break the frangible member in response to the first predetermined pressure and move the first tubular member relative to the second tubular member after the frangible member is broken.

21. The method according to claim 20, further comprising the step of forming a latching profile on an interior surface of the first tubular member, the latching profile being internally engageable by a shifting tool, whereby axial force may be applied to the first tubular member, after engaging the shifting tool with the latching profile, to break the frangible member and move the first tubular member axially relative to the second tubular member.

22. The method according to claim 20, further comprising the steps of:

forming a first aperture on an exterior surface of the first tubular member, and forming a second aperture on an interior surface of the second tubular member opposite the first aperture and aligned therewith;

and wherein the frangible member providing step comprises installing a shear pin into the first and second apertures.

23. Wellbore equipment positioning apparatus, comprising:

an outer tubular member having upper and lower ends, and inner and outer side surfaces;

an inner tubular member having upper and lower ends, and inner and outer side surfaces, the inner tubular member being coaxially and telescopingly disposed relative to the outer tubular member;

a ball catcher sealingly attached to the inner tubular member, the ball catcher being configured for ball releasement at a first predetermined pressure;

a fastener releasably securing the inner tubular member against longitudinal movement relative to the outer tubular member, the fastener releasing the inner tubular member for longitudinal movement relative to the outer tubular member at a second predetermined pressure, the second predetermined pressure being less than the first predetermined pressure; and a seal disposed between the inner tubular member and the outer tubular member, the seal sealingly contacting the inner tubular member outer side surface and the outer tubular member inner side surface.

24. The apparatus according to claim 23, wherein inner tubular member lower end extends longitudinally and outwardly from the outer tubular member lower end, and the ball catcher is sealingly attached to the inner tubular member lower end.

25. The apparatus according to claim 23, wherein the outer tubular member further comprises first and second longitudinally spaced apart radially inwardly reduced portions formed on the outer tubular member inner side surface, and the inner tubular member further comprises a radially outwardly enlarged portion formed on the inner tubular member outer side surface, the radially outwardly enlarged portion being disposed between the first and second radially inwardly reduced portions.

26. The apparatus according to claim 23, further comprising a shifting tool engagement profile formed on the inner tubular member inner side surface.

27. Apparatus for positioning equipment in a subterranean well, the apparatus comprising:

first and second telescopingly disposed tubular members;

an expandable sealing surface attached to the first tubular member; and a release mechanism releasably securing the first and second tubular members against relative axial displacement therebetween, the release mechanism releasing the first and second tubular members for relative displacement therebetween when a first predetermined pressure differential is created across the expandable sealing surface, and the expandable sealing surface expanding when a second predetermined pressure differential is created across the expandable sealing surface.

28. A method of positioning equipment in a subterranean well, the method comprising the steps of:

installing an expansion joint in a tubular string between the earth's surface and the equipment, the expansion joint including first and second telescopingly disposed tubular members, an expandable sealing surface attached to the first tubular member, and a release mechanism releasably securing the first and second tubular members against relative axial displacement therebetween;

creating a first predetermined pressure differential across the expandable sealing surface, thereby releasing the release mechanism, causing the expansion joint to axially elongate, and repositioning the equipment in the well; and creating a second predetermined pressure differential across the expandable sealing surface, thereby expanding the expandable sealing surface.

* * * * *